US007069614B1

(12) United States Patent
Sivachenko et al.

(10) Patent No.: US 7,069,614 B1
(45) **Date of Patent: *Jul. 4, 2006**

(54) MODULAR SPAN MULTI-CELL BOX GIRDER BRIDGE SYSTEM

(75) Inventors: Eugene Sivachenko, Redding, CA (US); Jiri Strasky, Brno (CZ)

(73) Assignee: Manufacturers Equity Trust, Redding, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/004,749

(22) Filed: Jan. 8, 1998

Related U.S. Application Data

(60) Provisional application No. 60/034,901, filed on Feb. 28, 1997.

(51) Int. Cl.
*E01D 19/12* (2006.01)
*E01D 21/00* (2006.01)

(52) U.S. Cl. ..... 14/73; 14/74.5; 14/77.1; 52/579; 52/789.1

(58) Field of Classification Search ..... 14/2.4, 14/6, 73, 74.5, 77.1, 78; 52/579, 789.1
See application file for complete search history.

(56) References Cited

U.S. PATENT DOCUMENTS

| | | | | | |
|---|---|---|---|---|---|
| 1,913,342 | A | * | 6/1933 | Schaffert | 52/579 |
| 1,972,570 | A | * | 9/1934 | Moore | 52/579 |
| 1,988,314 | A | * | 1/1935 | Higley | 52/579 |
| 2,026,278 | A | * | 12/1935 | Higley | 52/579 |
| 2,177,036 | A | * | 10/1939 | Greulich | 52/579 X |
| 2,424,080 | A | * | 7/1947 | Engstrom | 52/579 |
| 2,832,300 | A | * | 4/1958 | Jacobson | 52/579 |

(Continued)

FOREIGN PATENT DOCUMENTS

| | | | | |
|---|---|---|---|---|
| DE | 2014157 | * | 11/1971 | 52/579 |
| FR | 721537 | * | 3/1932 | 52/579 |

OTHER PUBLICATIONS

Translation of French Language Patent No. 721,537, Mar. 1932.*

*Primary Examiner*—Thomas B. Will
*Assistant Examiner*—Gary S. Hartmann
(74) *Attorney, Agent, or Firm*—Townsend and Townsend and Crew LLP

(57) ABSTRACT

A bridge is constructed using simply structured, longitudinal, modular deck sections or cells that are fabricated in a shop and shipped to the jobsite for quick assembly and erection. Each section has generally horizontal upper and lower members and at least one generally vertical member connected between the upper and lower horizontal members. The sections may be C-shaped, Z-shaped, or shallow U-shaped, and are connected in series. The upper and lower horizontal members of each section overlap respectively portions of the upper and lower horizontal members of the adjacent section to form overlapped regions. The connection sections define a plurality of closed cells. Open cells at the ends may be closed using appropriate end section(s) that may be shallow C-shaped or J-shaped. The sections are roll-formed or press braked from metal sheets or plates. The sections are connected together to form a multi-cell box girder bridge module by mating and welding or bolting the overlapped regions. Various corrugations or support plates may be added for strength. A bridge system may be formed by a single bridge module or by connecting a plurality of bridge modules.

62 Claims, 38 Drawing Sheets

U.S. PATENT DOCUMENTS 2,910,152 A * 10/1959 Edgar ..... 52/579 X
3,173,383 A * 3/1965 Eggert, Jr. ..... 52/579 X
3,984,961 A * 10/1976 Chieger et al. ..... 52/579 X
4,129,917 A * 12/1978 Sivachenko et al. ..... 14/73
4,289,420 A * 9/1981 Davis et al. ..... 404/35
4,706,319 A 11/1987 Sivachenko et al. ..... 14/73
4,709,435 A * 12/1987 Stemler ..... 14/73
5,033,147 A * 7/1991 Svensson ..... 14/73
5,339,475 A * 8/1994 Jaeger et al. ..... 14/73
5,400,454 A * 3/1995 Cunningham ..... 14/77.1
5,425,152 A * 6/1995 Teron ..... 14/77.1
5,603,134 A * 2/1997 Whipkey et al. ..... 14/2.4
5,651,154 A * 7/1997 Ahlskog et al. ..... 14/73 X

* cited by examiner

SECTION A–A

SECTION B–B

SECTION D–D

SECTION C–C

SECTION B–B

SECTION A–A

SECTION A–A

SECTION B–B

SECTION A–A

SECTION C–C

SECTION B–B

SECTION A–A

SECTION G–G

SECTION F–F

SECTION B–B

SECTION A-A

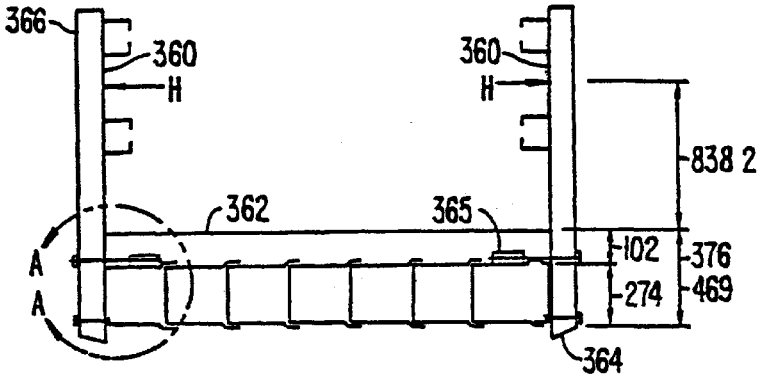
FIG. 70. H = 44.5 KN
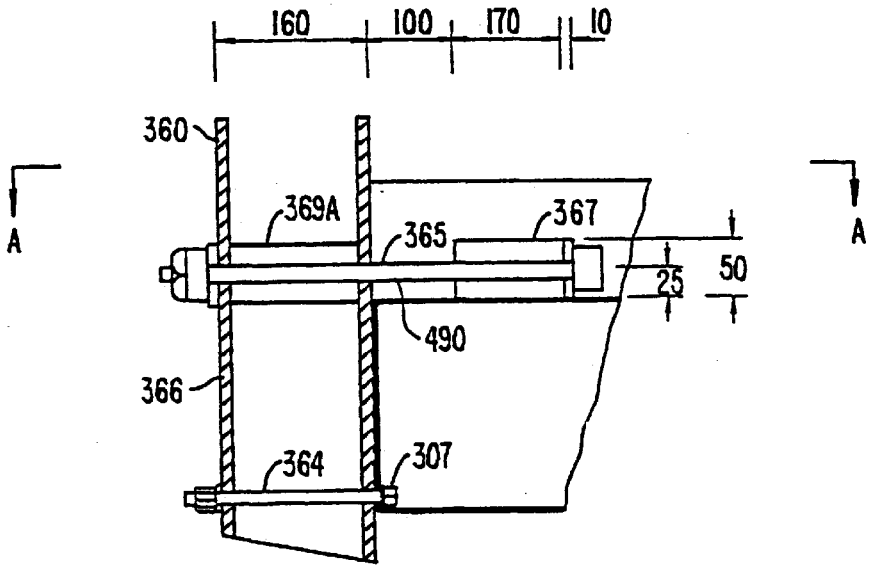
DETAIL A
FIG. 71.
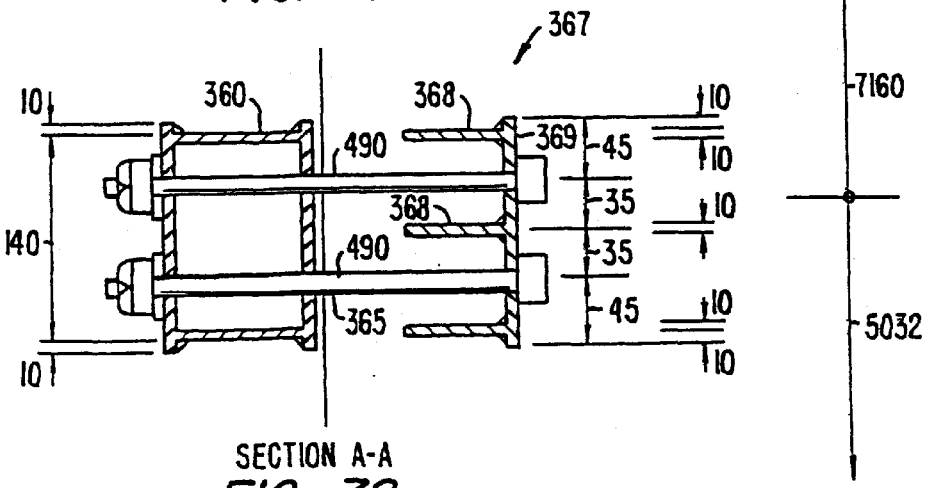
SECTION A-A
FIG. 72.

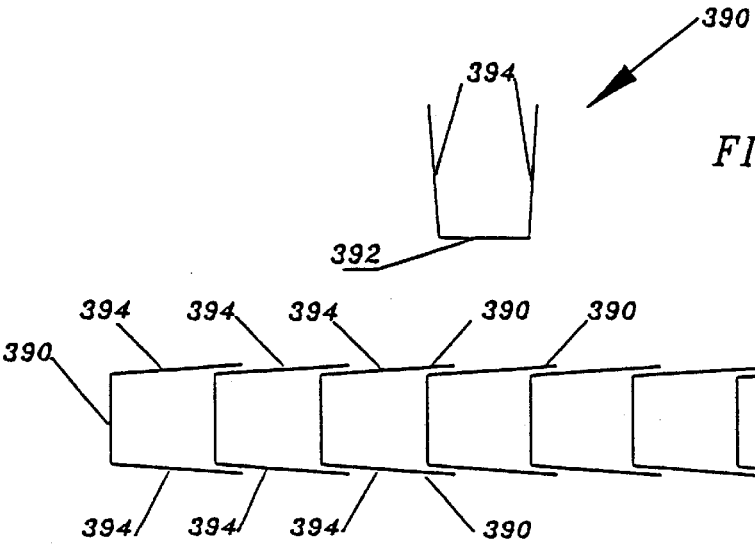
FIG.76
FIG.77
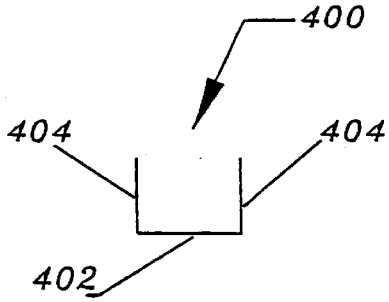
FIG.78
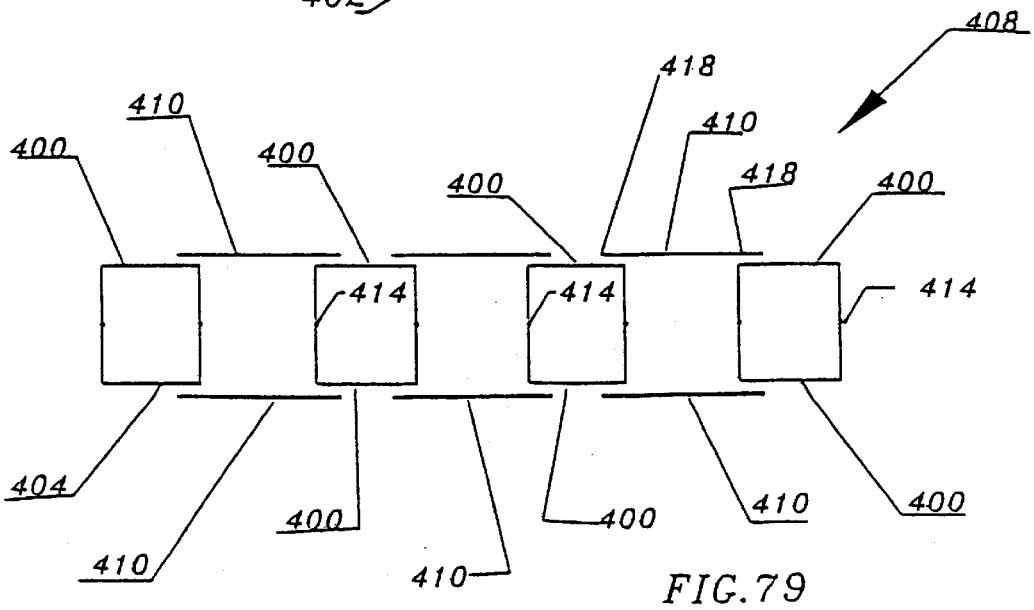
FIG.79

MODULAR SPAN MULTI-CELL BOX GIRDER BRIDGE SYSTEM

This application is based on and claims the priority of provisional application, Ser. No. 60/034,901, filed Feb. 28, 1997.

BACKGROUND OF THE INVENTION

Bridges are common and have different designs. One type of bridge is known as the short span bridge which has a relatively short span of, for instance, 80 feet. There are basically two styles of composite short span bridges predominately in use. Both types use supporting longitudinal wideflange beams or girders as the main support of the bridge decks.

The first type uses wood such as plywood sheets or metal forms or both kinds of forms between the girders to provide the forms as support for the steps of installing reinforcing steel and pouring concrete to construct the bridge deck (hereinafter referred to as "Type 1" construction). Typically, four longitudinal steel girders span two steel piers that are made of steel girders. A concrete deck is poured in place on top of the four steel girders. The concrete deck is secured to the steel girders generally by shear studs welded in the vertical position to the top flange of the steel girders and imbedded in the steel reinforced concrete deck. The structural steel in the Type 1 bridge can be erected quickly once the concrete footings/piers are poured and ready for erection of the steel. Such a construction, however, requires a great deal of labor to form the roadway or deck out of plywood and to install the reinforcing steel before pouring and finishing the concrete to create the deck. After the concrete is poured, bridge barrier rails must be formed, reinforcing steel installed, and concrete poured and finished. All the wood forms and the supporting falsework have then to be removed after the concrete is cured to reach its required strength, which may take as long as 30 days.

In the other type, the longitudinal steel girders are covered with corrugated steel bridge flooring, which is used as a form generally welded on top of and across the girders. Asphalt aggregate or concrete is then poured over the bridge flooring which remains in place as part of the bridge (hereinafter referred to as "Type 2" construction).

SUMMARY OF THE INVENTION

The present invention relates to construction of a bridge using modular, steel deck sections that can be shop-fabricated in modular widths and lengths and shipped to the jobsite for quick intensive assembly and erection. The assembly is less labor intensive than those described above. The assembled modular deck sections serve as a form for the application of either concrete or asphalt aggregate roadway surface. The modular deck section design may be used in short span bridges having lengths of over about 100 feet, or longer bridges of up to about 200 feet.

In accordance with an aspect of the present invention, a bridge for carrying traffic between spaced-apart supports for the bridge has a first module. The first module comprises a plurality of longitudinal sections each having generally horizontal upper and lower members overlapping respectively portions of the generally horizontal upper and lower members of a neighboring section. Each longitudinal section has at least one generally vertical member extending between the upper and lower horizontal members and spaced from a generally vertical member of a neighboring section to define one of a plurality of closed cells.

Another aspect of this invention is a bridge system comprising a bridge which includes an end supported by an abutment and having a side plate. The bridge includes an anchor connected to a top portion. A guardrail post is disposed adjacent the side of the bridge. At least one attachment fastener extends through and is fastened to a portion of the side plate and the guardrail post. At least one anchor fastener is supported by the anchor and extends through and is fastened to a portion of the guardrail post.

In accordance with yet another aspect of the invention, a bridge system comprises a bridge form which includes two ends supported on two abutments. A deck is supported over the bridge form and has an end extending beyond and overhanging one end of the bridge form by an overhanging portion. The overhanging portion has an upper surface for supporting a guardrail post.

BRIEF DESCRIPTION OF THE DRAWINGS

The preferred embodiments of this invention, illustrating all their features, will now be discussed in detail. These embodiments depict the novel and nonobvious bridge system of this invention shown in the accompanying drawings, which are included for illustrative purposes only. These drawings include the following figures, with like numerals indicating like parts:

FIG. 52 is a cross-sectional view along D—D of the bridge system of FIG. 51 schematically illustrating a connection of support plates to the bridge modules.

FIG. 53 is a cross-sectional view along E—E of the bridge system of FIG. 51 schematically illustrating another connection of support plates to the bridge modules.

FIG. 70 is an elevational end view schematically illustrating an embodiment of a connection between guardrail posts and the sides of a bridge.

FIG. 71 is an elevational view schematically illustrating the connection of FIG. 70 at Detail A.

FIG. 72 is a partial top plan view schematically illustrating the connection of FIG. 70 at Detail A.

FIG. 76 is an elevational view of a divergent C-shaped section schematically illustrating another embodiment of a modular section of the present invention.

FIG. 77 is an elevational view schematically illustrating a bridge module comprising the divergent C-shaped sections of FIG. 76.

FIG. 78 is an elevational view of a shallow U-shaped section schematically illustrating an other embodiment of a modular section of the present invention.

FIG. 79 is an elevational view schematically illustrating a bridge module comprising the shallow U-shaped sections of FIG. 78.

DETAILED DESCRIPTION OF THE INVENTION

Multi-Cell Bridge Modules

Figures 1, 2:
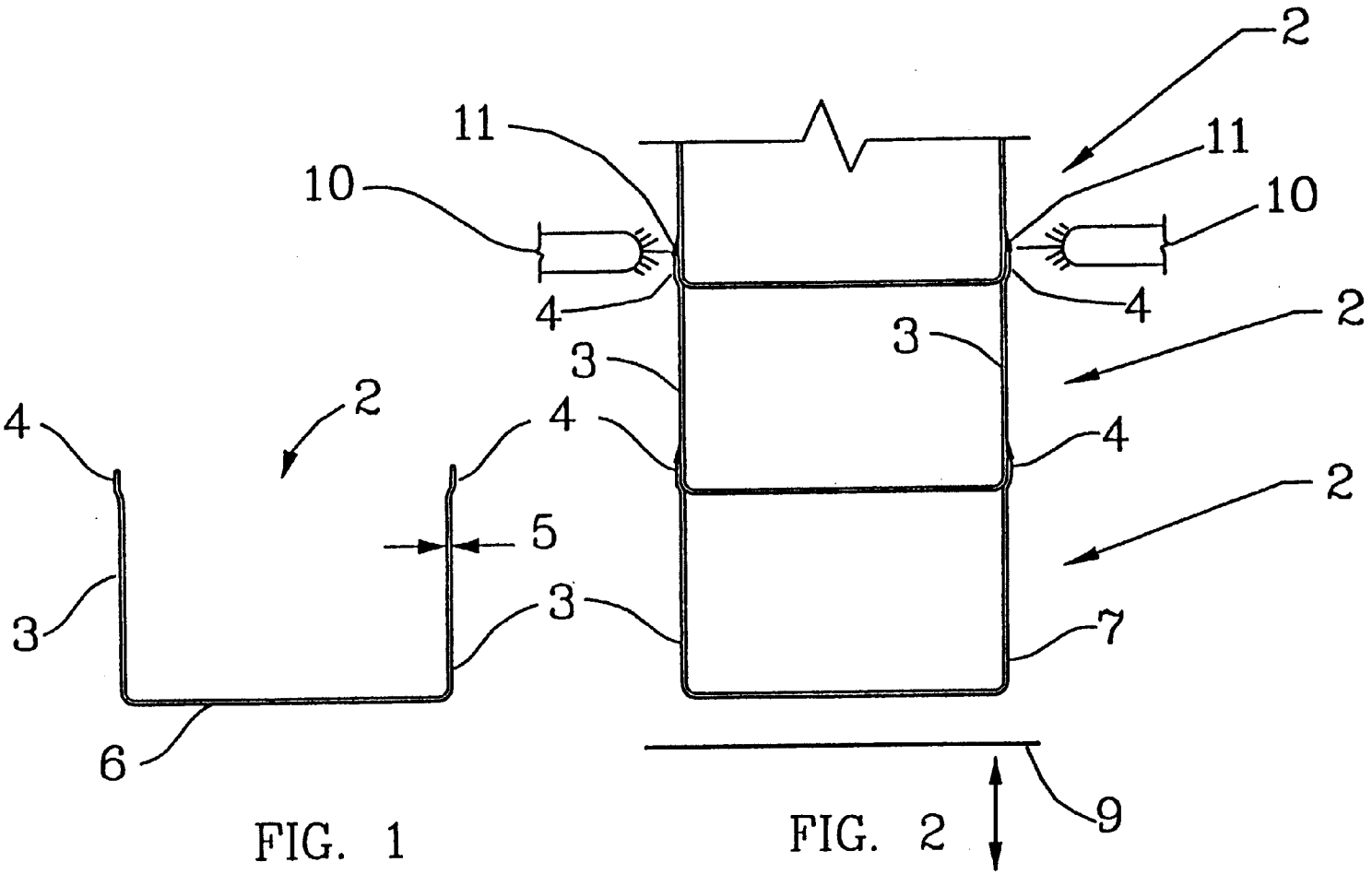
FIG. 1 is an elevational view schematically illustrating a C-shaped modular section or cell in accordance with the present invention.
FIG. 2 is an elevational view schematically illustrating the assembly of a series of C-shaped modular sections having an embodiment of offsets.

Referring to FIG. 1, a U-shaped or C-shaped, roll-formed, longitudinal section of a structural beam 2 is typically produced in a roll-forming or other process lines using sheet or metal plate. The section of the beam 2 has two generally equal length legs 3 extending from a base 6 with two short offset legs 4 at the top. The beam 2 may be made of steel or metal of similar strength and properties. The offset of the offset legs 4 is approximately equal to the thickness 5 of the metal sheet. The overall height of the two legs 3 may vary from about 12 inches to about 24 inches or higher, depending on the metal thickness 5 and its physical properties and the span length of the bridge to be built. The offset legs or lips 4 are typically approximately 2 inches long. In construction of a bridge, the structural beam 2 is rotated by 90° along its longitudinal axis so that one of the two legs 3 becomes the top surface to form a roadway surface and the other becomes the bottom surface of the bridge.

Figure 3:
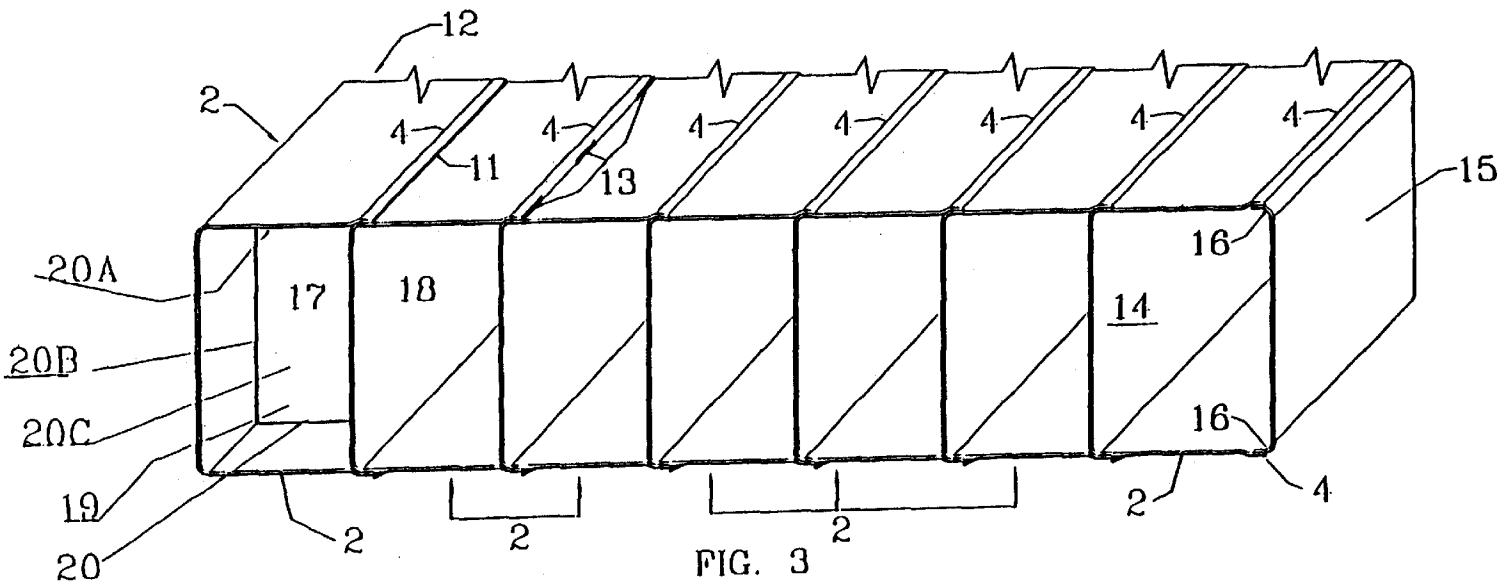
FIG. 3 is a perspective view schematically illustrating an assembled bridge module utilizing the C-shaped modular sections of FIG. 1.

As illustrated in FIG. 2, three C-shaped beams 2 (with one shown only partially) are combined by nesting or joining neighboring beams 2. The base 6 of one beam 2 is inserted into the offset lips 4 of the neighboring beam 2 to create a generally horizontally overlapped region when viewed from a C-shaped perspective (vertical overlapped region when viewed from a U-shaped perspective). The base 6 and the offset lips 4 desirably form a tight fit together. The assembly may involve dropping each section 8 straight down a previously assembled section 7. FIG. 2 shows the C-shaped beams 2 stacked vertically; however, the vertical stack is rotated to become a horizontal row of C-shaped beams 2 for constructing the bridge, as shown in FIG. 3. A platen 9 under the assembly may be raised or lowered as desired to allow the two welder's contact nozzles 10, one on each side concentrically located facing each other, to make continuous or skip fillet welds 11 along the full length of the bridge at the overlapped region with one weld on each side simultaneously. The welds 11 join the vertical legs 3 (closed portion) of one section to the lips 4 (open portion) of an adjacent section.

FIG. 3 illustrates an assembled bridge module 12 that may desirably be made to a size for truck shipment. For instance, the bridge module 12 may have a maximum width of 100 inches to avoid a wide load permit, or, if necessary to obtain a wide load permit, wider widths such as up to 12 feet. The span of the bridge is the length of each roll-formed section 2, which is the same length in most applications. The bridge module 12 comprises seven identical U-shaped or C-shaped sections 2 of FIG. 1 that are assembled as illustrated in FIG. 2. An eighth section, the C-shaped closure section 15, is used to close the open portion of the seventh C-shaped section 2. In the embodiment shown, the C-shaped closure section 15 has two legs 16 that are substantially shorter than the legs 3 of the other seven sections 2 and just long enough to cooperate with the offset lips 4 of the seventh section 2.

In other embodiments, the bridge module 12 may include different numbers of the C-shaped sections 2. For instance, there may be six C-shaped sections 2.

The bridge module 12 includes a plurality of end diaphragm plates 19. One end diaphragm plate 19 is shown in FIG. 3 disposed inside the first closed cell 17. The end diaphragm plate 19 has a dimension equal to the internal C-shaped dimension of the first closed cell 17, and is welded along all four sides 20 to each section 2. While welding along all four sides 20 provides an air-tight cell, welding along the three sides 20, 20A, 20B of the C-shaped section is structurally sufficient. The first closed cell 17 includes a pair of the diaphragm plates 19, one welded adjacent each end of the section 2 to create a closed cell 17. The diaphragm plates 19 are used for the second section 2 to create a second closed cell 18 and to create the remaining closed cells up to the last closed cell 14, which is bounded by the seventh section 2 and eighth section 15. When installed on both ends and welded along all four welded sides 20, the welded closure or diaphragm plates 19 create seven air-tight cells (17, 18, . . . 14) so that the interiors of the closed cells are corrosion proof. The little amount of oxygen that may be trapped in the closed cells will be oxidized within the sealed interior and no further corrosion inside will take place during the life of the bridge. The module 12 is a multi-cell box girder bridge module made with the closed cells (17, 18, . . . 14) that can be shop-fabricated, shipped to the jobsite, and assembled.

Figure 4A:
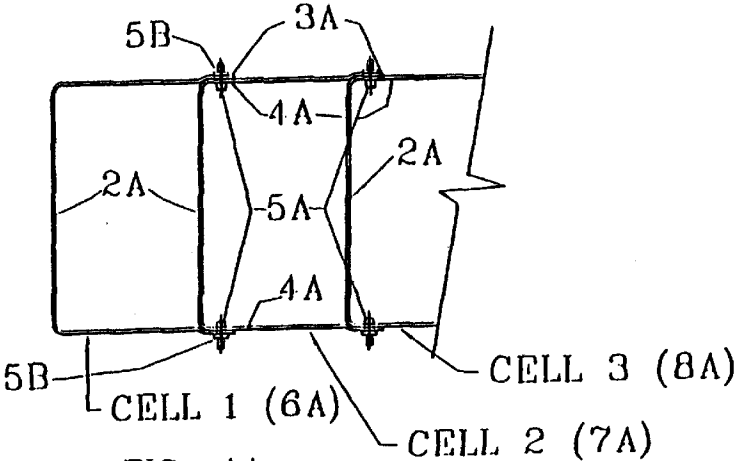
FIG. 4A is an elevational view schematically illustrating another embodiment of a portion of the assembled bridge module of FIG. 3 assembled by bolting.
Figure 4:
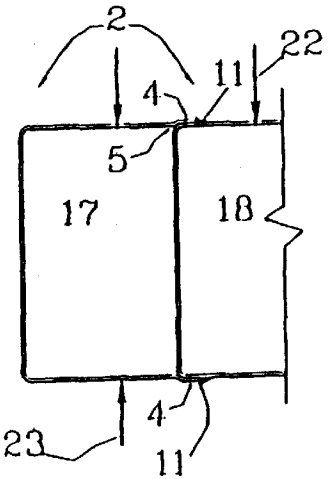
FIG. 4 is an elevational view schematically illustrating an embodiment of a portion of the assembled bridge module of FIG. 3 assembled by welding.

FIG. 4 shows the nested C-shaped sections 2 forming the first and second closed cells 17, 18. The two vertical arrows 22, 23 represent wheel loads from vehicles moving across the top of the bridge constructed with the closed cells (17, 18, . . . 14). These loads may be extremely high and tend to separate each pair of two adjacent cells by differential loads 22, 23. The multi-cell bridge module 12 is better able to withstand the loads 22, 23 because the offset lips 4 are held in place sufficiently by the 3/16" fillet welds 11 along the top and bottom, and the C-shaped sections 2 are selected to have sufficient thickness and strength to resist the loads 22, 23. Even if the welds 11 had minor flaws, they would still be able to resist vertical separation because the portion 5 of the C-shaped sections 2 adjacent the welds 11 would have to shear across the metal thickness as well for separation. The proper selection of the thickness of the sections 2 provides a safety factor in the design to prevent accidental failure of the bridge that would cause injury or death of individuals riding over the top surface of the bridge.

Referring to FIG. 4A, three C-shaped sections or cells 2A, which are similar to the C-shaped sections 2 of FIGS. 1–4, are nested and assembled together by bolting rather than welding. In this embodiment, the offset lips 3A of the sections 2A have round holes prepunched and in the corresponding region 4A on the legs of the adjacent section 2A. Bolts 5A are installed through the holes and tightened with, for example, nuts 5B. The spacing for the bolts may be as close as 6 inches from center to center along the longitudinal offset lips 3A. Other methods of assembling the C-shaped sections 2, 2A known to those in the art may be used.

As discussed below, threaded pipe couplers can be welded into each end diaphragm plate 19 at both ends of the closed cells (17, 18, . . . 14). The pipe couplers can have corresponding pipe plugs installed into the pipe couplers so that interior inspections can be conveniently made or an inert gas such as nitrogen or argon can be initially introduced and sealed in the shop prior to shipment.

Manufacturing of the Multi-Cell Box Girder Bridge Modules

Figures 5, 6, 7:
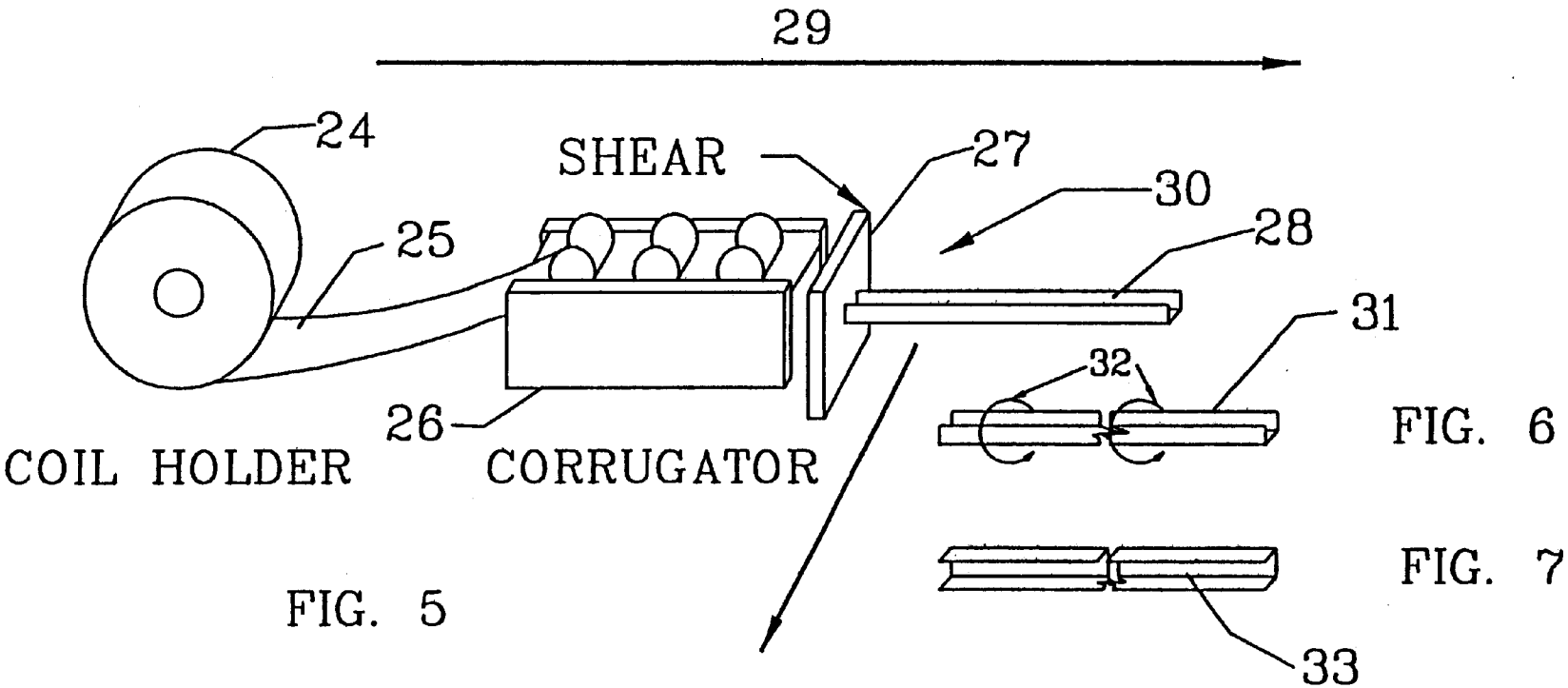
FIGS. 5–7 are perspective views schematically illustrating an embodiment of a sheet roll-forming manufacturing line for making the modular sections of FIG. 1.

FIG. 5 shows a plate roll-forming manufacturing line used to make the beam sections (2, 2A, and 15) shown in FIGS. 3–4A above, which are typically made of steel. A flat-roll steel coil 24 supported on a coil holder (not shown) feeds a flat-roll steel plate 25 into a corrugator 26. The corrugator 26 produces from the plate 25 a continuously formed C-shaped section 28 that resembles the beam sections 2, 2A, or 15 of FIGS. 1–4A. The manufacturing line further includes an in-line shear 27 with contoured blades that shear the corrugated C-shaped section 28 to the desired length to produce a plurality of the C-shaped sections 31 for the desired bridge span length, as shown in FIG. 6. The steel plate 25 moves in the direction denoted by the arrow 29 through the corrugator 26 and shear 27 in the processing line. Alternatively, the flat-roll plate 25 may be sheared to the desired bridge span length first before being formed by the corrugator 26 without post-shearing. While FIG. 5 shows one production line following the corrugator 26, it may be desirable to provide multiple production lines because the time taken by the corrugator 26 typically is substantially shorter than that required for some stations of subsequent operations.

Figures 8, 9, 10, 11:
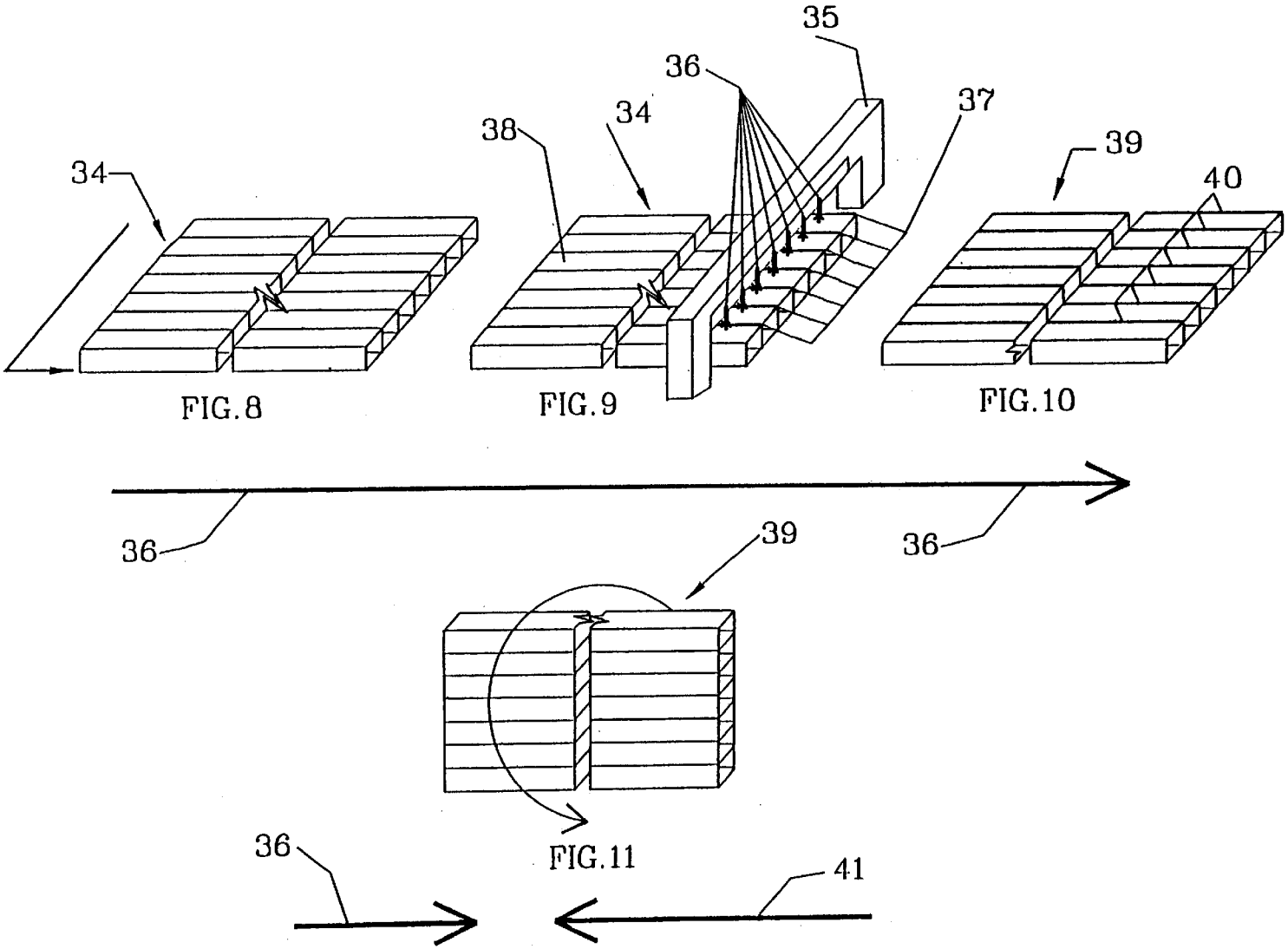
FIGS. 8–11 are perspective views schematically illustrating an embodiment of a manufacturing line for welding the sections roll-formed in FIGS. 5–7 to form the assembled bridge module of FIG. 3.

In FIG. 6, the curved arrows 32 illustrate the direction that the roll-formed section 31 is to be rotated along its longitudinal axis. The roll-formed section 31 is rotated by 90°, as shown in FIG. 7. FIG. 8 shows an assembly 34 of eight roll-formed sections 31 in a manner illustrated in FIG. 3, but which have not yet been welded together. The assembly 34 is welded together in the next station, which is a welding station shown in FIG. 9. The welding station includes a welding fixture or gantry 35 having seven submerged arc welding nozzles 36 to create seven welds 37 simultaneously on the top side 38 of the eight roll-formed sections 31 of the assembly module 34. More or fewer than seven welding nozzles 36 may be used, depending on the number of sections 28 and the size of the gantry 35. The arrow 36 indicates the movement of the assembly 34 through the welding station.

Referring to FIG. 10, the module 34 passing through the welding station changes into a module 39 with a welded upper portion exiting the gantry 35. The module 39 has seven completed fillet welds 40 resulting from the welding at the welds 37 by the nozzles 36 across the full length of the module 34. Previous box girders require full penetration welds. Advantageously, the present invention does not require full penetration welds because of the use of the lips 4 (FIG. 4), making the bridge construction faster and more efficient. To create the relative motion between the assembly module 34 and the welding gantry 35, either the gantry 35 is stationary and the module 34 moves, or the module 34 is stationary and the gantry 35 is propelled over the stationary module 34.

FIG. 11 illustrates the rotation by 180° of the partially welded module 39 about its longitudinal axis to move the unwelded bottom to the top. The rotated module 39 is moved in a reverse direction as indicated by the arrow 41 to pass through the welding gantry 35 of FIG. 9 with the unwelded bottom facing the welding nozzles 36 to make seven additional longitudinal welds at the bottom (not illustrated). This processing step produces a module welded on both sides. Another processing station (not shown) may be provided to weld the end diaphragm plates 19 to both sides to create the closed cells (17, 18, . . . 14) as shown in FIG. 3. An additional fabrication station may be provided to weld vertical guardrail post(s) to the proper side(s) of the particular modules, and/or to weld drilled and tapped plates along the inside or outside of the roll-formed beams for properly mounting guardrail posts in the field by bolting (not illustrated) (see FIGS. 18–24). The shop-fabricated module (s) are shipped to the jobsite for installation of the bridge (not shown).

Figures 12, 13, 14, 15, 16:
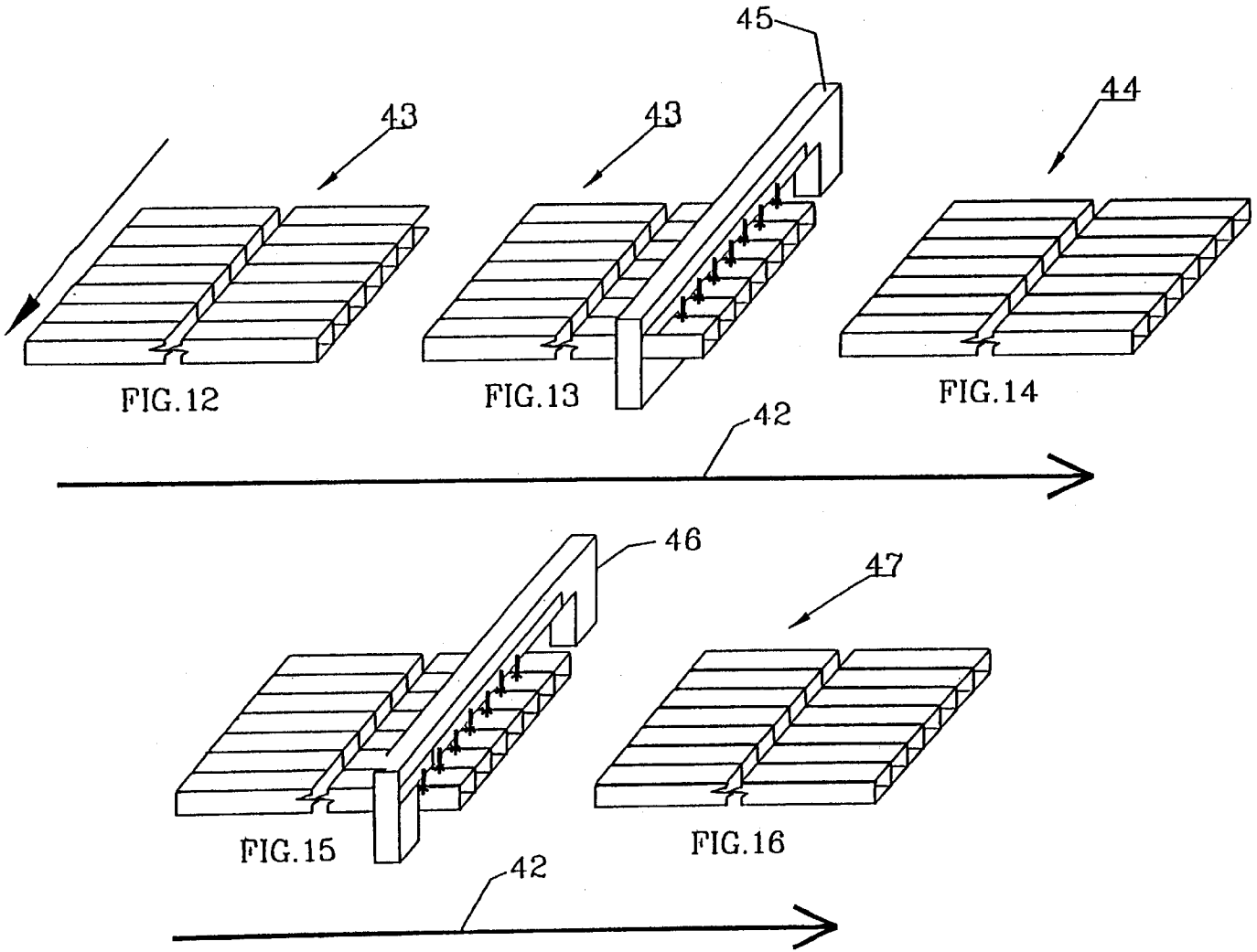
FIGS. 12–16 are perspective views schematically illustrating another embodiment of a manufacturing line for welding the sections roll-formed in FIGS. 5–7 to form the assembled bridge module of FIG. 3.

FIGS. 12–16 illustrate another process line that may replace the process line shown in FIGS. 8–11. In this process, the assembled module 43 of FIG. 12 (analogous to the module 34 of FIG. 8) moves through a first welding station 45 of FIG. 13 that may be similar to the welding station 35 of FIG. 9. FIG. 14 shows a module 44 exiting from the welding gantry 45 with the top seven longitudinal welds completed. The module 44 is rotated by 180° similar to that shown in FIG. 11 and is passed through a second welding station 46 illustrated in FIG. 15 to apply the additional welds. FIG. 16 shows a completed module 47 welded on both the top and bottom. As shown in FIGS. 12–16, the module 43 is processed along a line 42 with no reversal. Optional stations, desirably along the line 42, may be provided for welding the diaphragm plates 19 and/or guardrail support plates and/or drilled and tapped plates (not shown).

Figure 17:
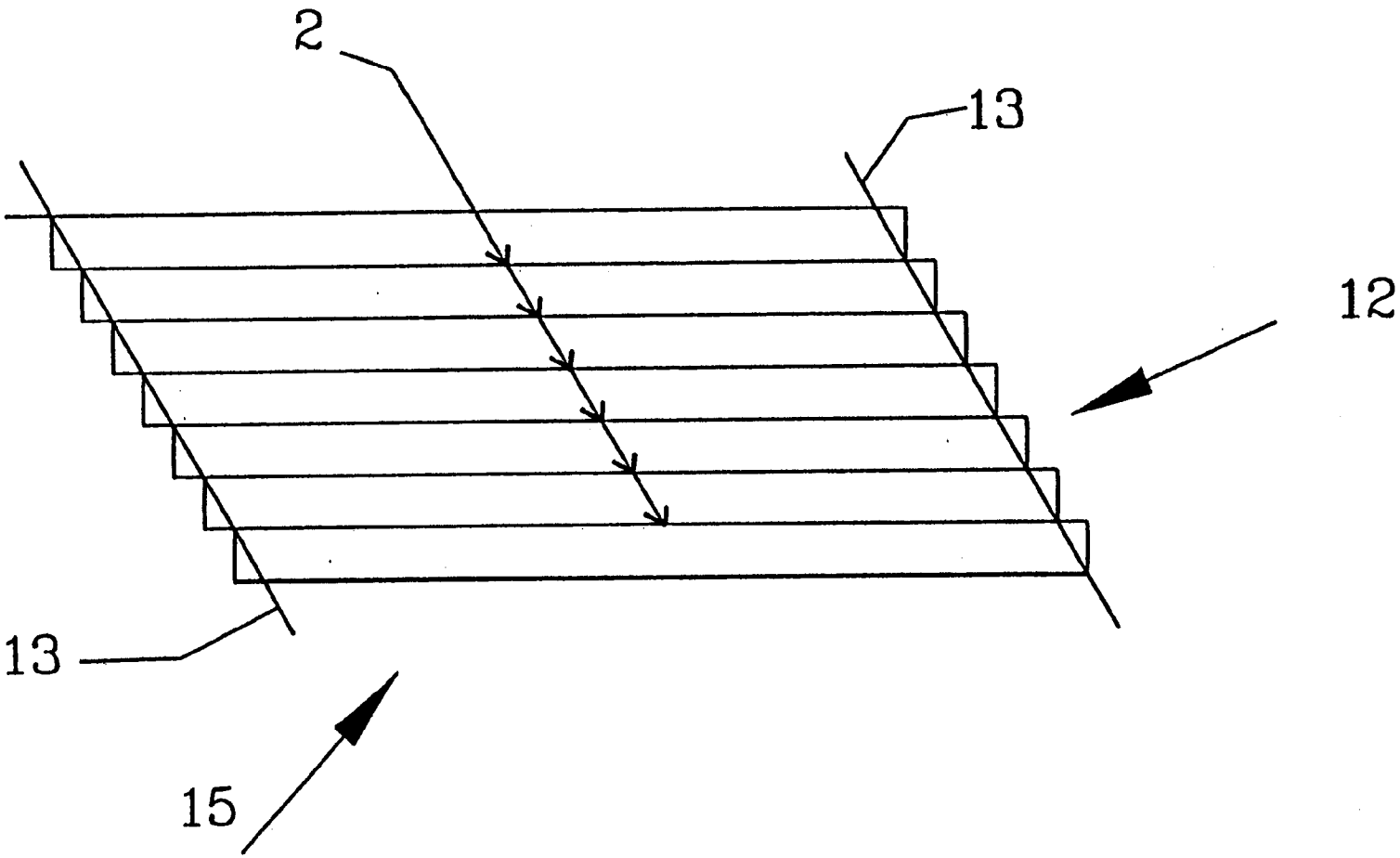
FIG. 17 is a top plan view schematically illustrating a skewed bridge made with the bridge modules of FIG. 3.

Referring to FIG. 17, a skewed bridge 12' with sections 2 assembled to have skewed ends may also be manufactured using the processing stations illustrated in FIGS. 5–16. In this embodiment, the individual shaped sections 2 are progressively offset to the same distance relative to each other parallel to the longitudinal axis of the bridge module 12'. The skewed ends of the module 12' are normally trimmed along each of the parallel slanted lines 13.

Modular Multi-Cell Box Girder Bridge System

Figure 19:
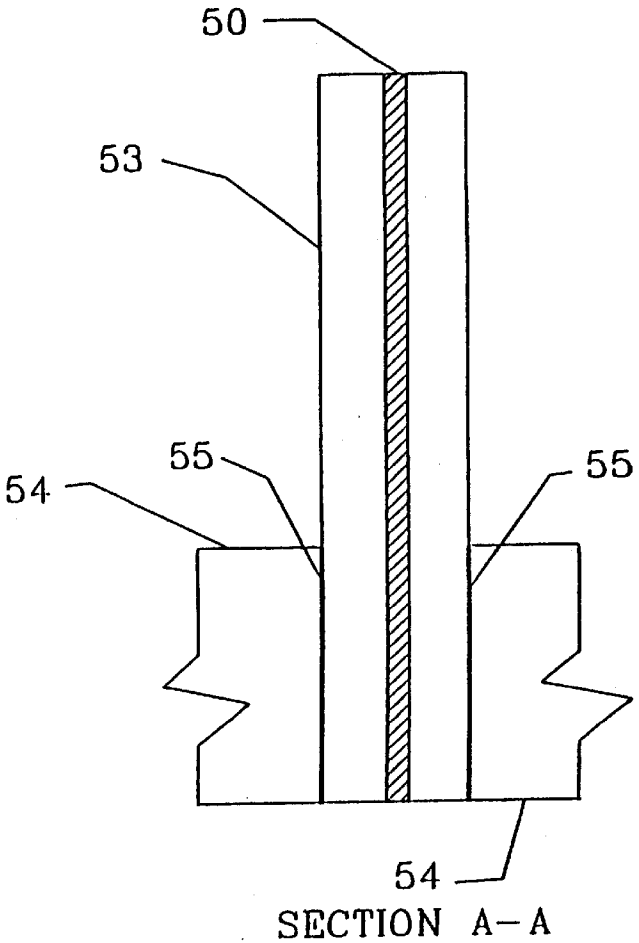
FIG. 19 is a cross-sectional view along A—A of the welded guardrail post of FIG. 18.
Figure 18:
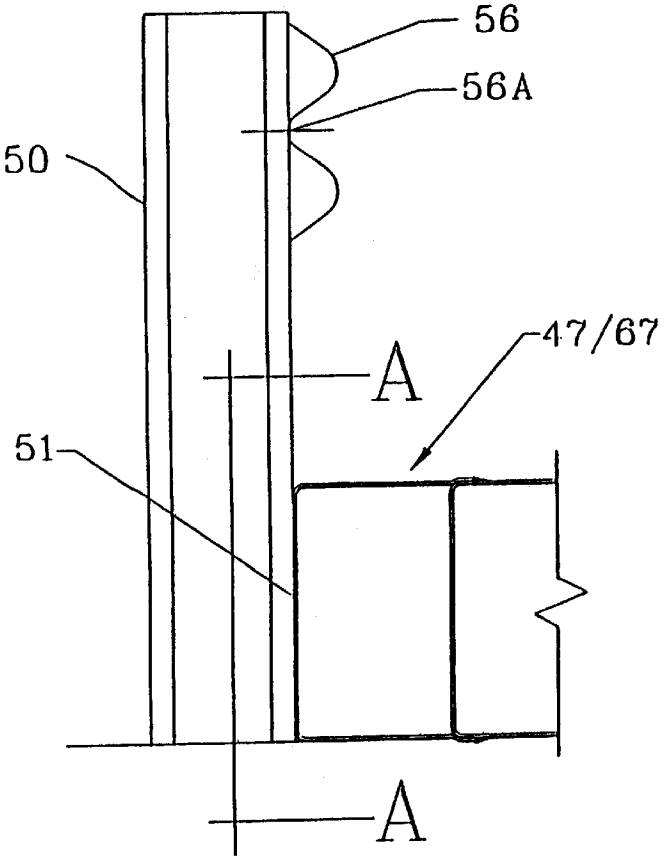
FIG. 18 is an elevational view schematically illustrating a guardrail post welded onto the side of the bridge module of FIG. 4.
Figure 21:
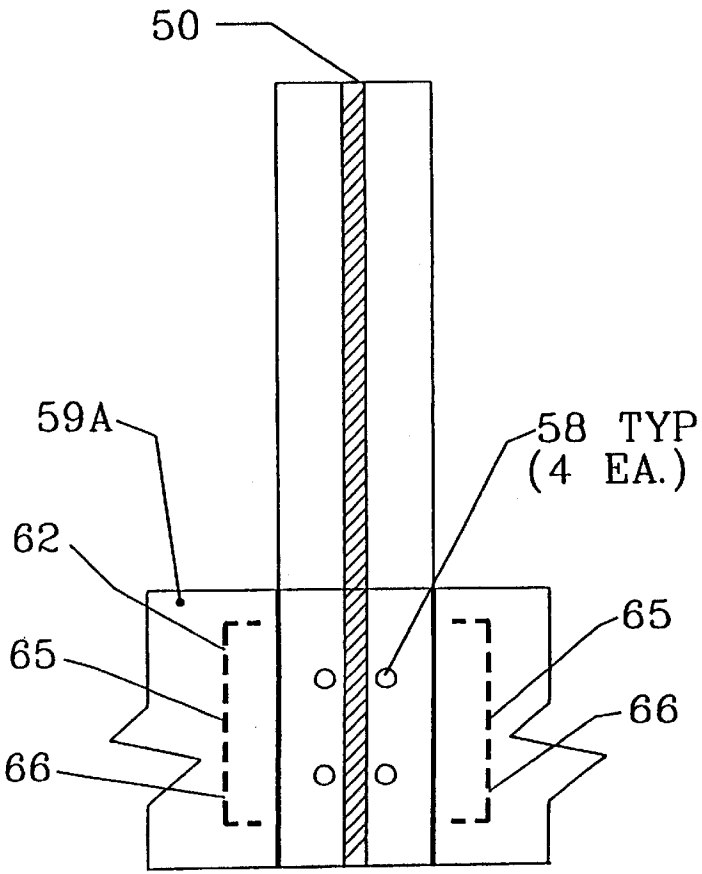
FIG. 21 is a cross-sectional view along B—B of the bolted guardrail post of FIG. 20.
Figure 20:
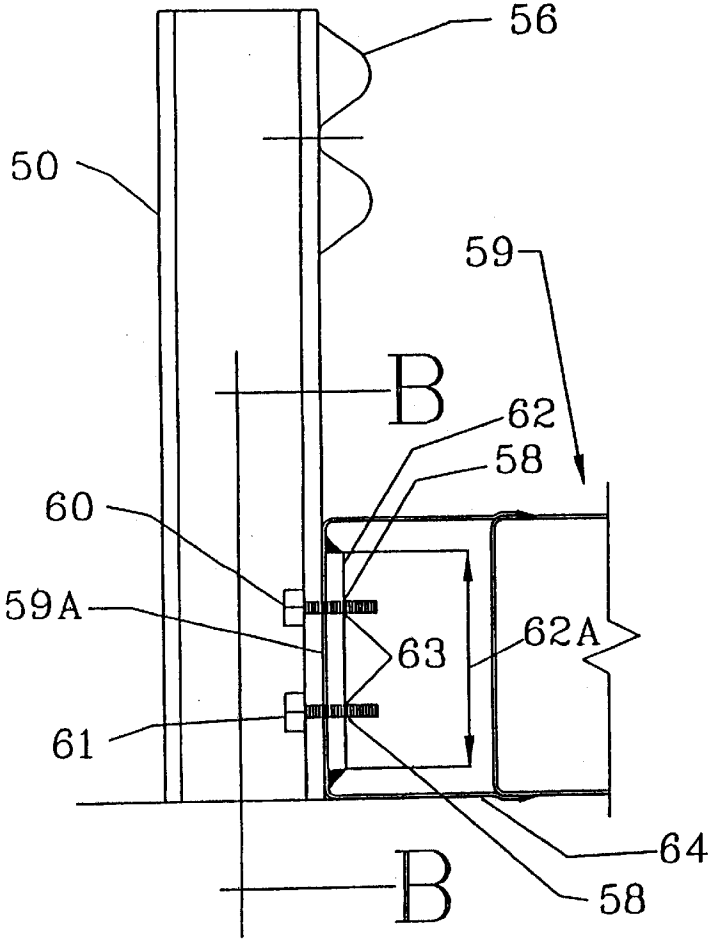
FIG. 20 is an elevational view schematically illustrating a guardrail post bolted onto the side of the bridge module of FIG. 4.
Figure 22:
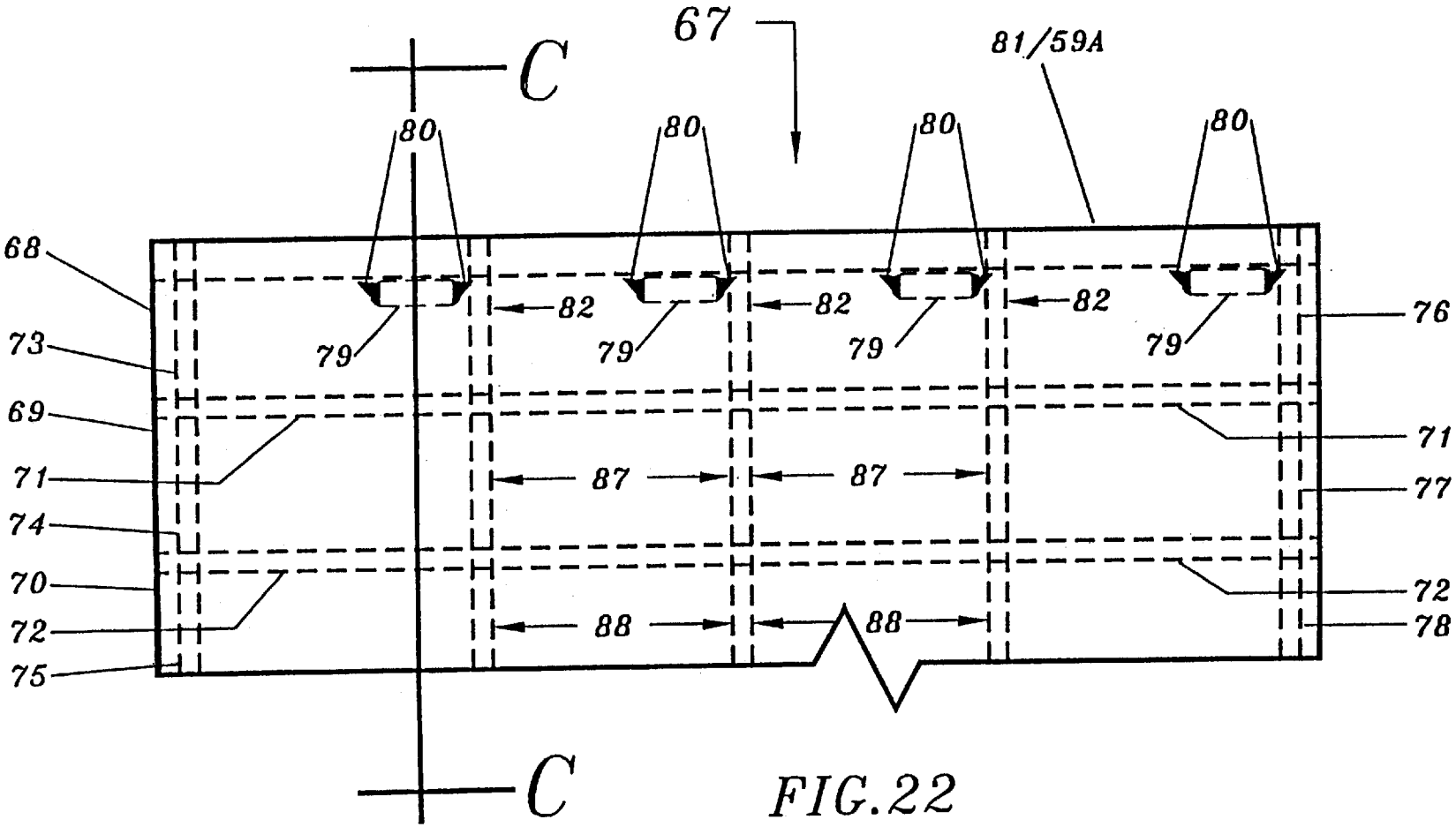
FIG. 22 is a top plan view illustrating three U-shaped bridge beams welded together with internal diaphragm plate weldments.
Figure 24:
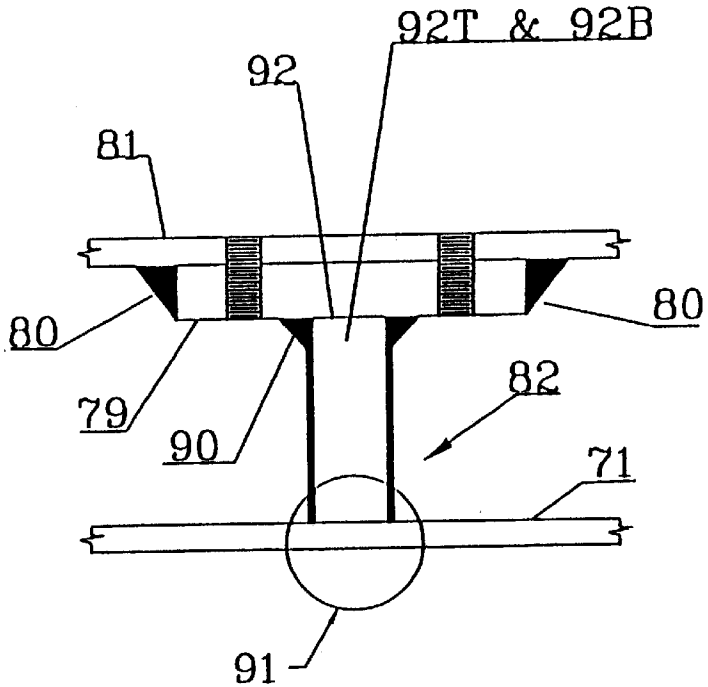
FIG. 24 is a cross-sectional view along D—D of the welded bridge modules of FIG. 23 illustrating two vertical welds of the drilled and tapped guardrail support plate.
Figure 23:
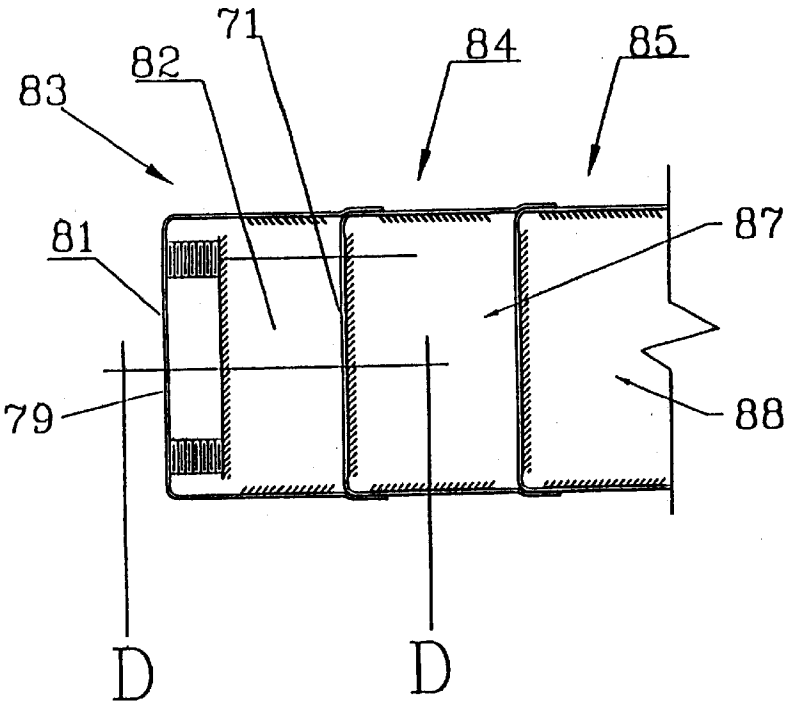
FIG. 23 is a cross-sectional view along C—C of the welded bridge modules of FIG. 22 illustrating the welding of a drilled and tapped guardrail support plate to the modules.

FIGS. 18–21 illustrate the addition of guardrail posts to the shop-fabricated module 47 for supporting guardrail or tube railing (not shown) typically seen on both sides of bridges. A vertical guardrail post is welded directly to the side of the bridge in FIGS. 18 and 19, while drilled and tapped backing/diaphragm plates shown in FIGS. 20 and 21 are welded into the bridge so that the guardrail posts may be installed by bolting in the field. FIGS. 22 and 23 also illustrate the addition of drilled and tapped plates to the module 67. FIG. 24 shows the welding of internal diaphragm plates. This additional processing may preferably be performed in the shop at additional manufacturing stations (not shown) or at the jobsite or in the field.

Referring back to FIGS. 18–19, a wideflange post 50 is welded along weld 51 to the outer left edge of the bridge module 52. A "W" Beam guardrail 56 is field-bolted at 56A to the post 50. The sectional view along A—A seen in FIG. 19 shows the flange 53 of the post 50 of FIG. 18 that may be shop-welded to the edge 54 of the bridge module 52 by two vertical fillet welds 55 on both sides.

Referring to FIGS. 20–21, a guardrail post 57 is bolted at locations 58 rather than welded to the bridge module 59. Two upper bolts 60 and two lower bolts 61 connect the post 57 to the external edge surface 59A of the module 59. A guardrail support plate 62, which may be made of steel, has a height 62A, and four holes 63 drilled and tapped therein accept the four bolts 60, 61 for fastening the prepunched post 57 to the end surface 59A of the module 59. The bolts 60, 61 may be about 1¼ inches in diameter, and the guardrail support plate 62 may be about 1¼ inches in thickness and about 10 inches wide. The plate 62 is advantageously shop-welded to the interior surface of the beam or section 64 of the bridge module 59 before the section 64 is assembled and welded longitudinally to an adjacent beam as shown above in one of the production lines, such as those shown in FIGS. 12–16. The section B—B taken from FIG. 20 and shown in FIG. 21 illustrates more clearly the welding of the drilled and tapped plate 62 along both vertical edges 66 to the inner surface 59A of the beam 64 at the welds 65.

FIG. 22 shows a bridge module 67 having three roll-formed beams 68, 69, 70 welded longitudinally together at the top at welds 71, 72. Analogous to the gusset or diaphragm plates 19 in the cell 17 of FIG. 3, the beams 68, 69, 70 have, respectively, end diaphragm plates 73, 74 75 at the left end of the module 67 in the welded position illustrated in broken lines to form closed cells (83, 84, 85 in FIG. 23). referring to FIG. 22, corresponding right-end diaphragm plates 76, 77, 78 are also shown. Drilled and tapped 1¼ inch thick guardrail support plates 79, which are analogous to the support plates 62 shown in FIGS. 20 and 21, are also shown in broken lines. Vertical welds 80 join these support plates 79 to the interior edge surface of the outside longitudinal edge 81 of the roll-formed beam 68. The support of the guardrail beams 56 is similar to that shown in FIGS. 20 and 21 with the vertical surface 59A. The strength of the connection of the guardrail posts 57 is transferred to the module 67 by welding the drilled and tapped plates 79 to the interior of the roll-formed beams 68, 69, 70 as close as practical to the left-end diaphragm plates 73, 74, 75 at the left end and to the right-end diaphragm plates 76, 77, 78 at the right end of the module 67. This configuration strengthens the area of the roll-formed beam 81 in the area of the welded plates 73, 74, 75 against any damage caused by impacts of vehicles transferred down to this area from the guardrail 56 and/or top area of the guardrail posts 57. Similarly, three sets of three interior diaphragm plates 82, 87, 88 similar in structure to the end diaphragm plates are provided to strengthen the areas of the welded drilled and tapped plates 79.

Referring to the section C—C in FIG. 23, three interior cells (83, 84, 85) of the bridge module 67 of FIG. 22 have the three welded diaphragm plates 82, 87, 88. The drilled and tapped guardrail support plate 79 is welded into the flat surface area of the interior of the outside beam 81, desirably along the full height of the flat surface inside the cell 83. The interior diaphragm plates 82 are advantageously welded in positions as close to the interior guardrail support plates 79 as practical if needed to strengthen this area from possible damage transferred down from the guardrail 56 above.

FIG. 24 shows a section D—D taken from FIG. 23 illustrating an arrangement to increase the strength of the area of the interior guardrail support plate 79 with two vertical welds 80. The circled area 91 shows the omission of potentially two additional vertical welds that structurally are not needed but may be provided at the intersection between the interior diaphragm plate 82 and the interior of the roll-formed beam 71. The omission represents substantial savings in time because it is not practical in fabrication to make these welds, besides not being needed, except by time-consuming plug welds to the interior beam surface 71. This plate 82, however, could be welded on three of its edges: the vertical welds 90, and the top horizontal weld 92T and bottom horizontal weld 92B at the interior of the top and bottom of the beam 81. These welds 92, 92T, 92B strengthen the surrounding area.

After the assembly of the bridge system, the components may be galvanized by known methods to resist corrosion. It is noted that the box girder bridge system of this invention advantageously minimizes the accumulation of birds thereon and bird droppings that are highly corrosive.

Additional Features

Offsets

Figure 25:
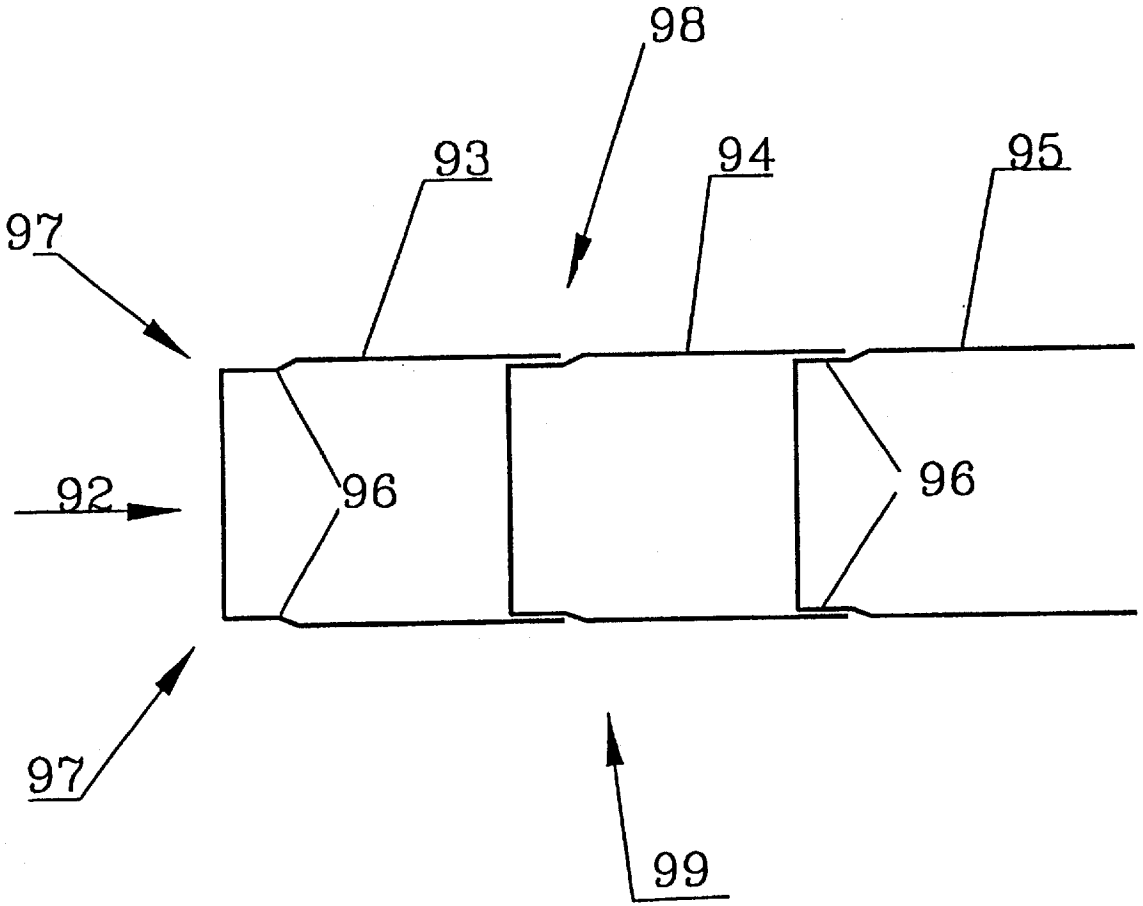
FIG. 25 is an elevational view schematically illustrating the assembly of a series of C-shaped modular sections having another embodiment of offsets different from those of FIG. 2.

FIG. 25 illustrates a line schematic end view of the left edge of a bridge module 92 having three C-shaped roll-formed beams 93, 94, 95 that include offsets 96 roll-formed into the 90° bend areas 97. The module 92 shown in FIG. 25 is similar to the module 12 shown in FIGS. 3 and 4. The difference lies in the configuration of the offsets 96. In FIG. 25, the offsets 96 produce a generally flat top and bottom surfaces 98, 99 of the bridge module 92 rather than the uneven surfaces with the protruding lips 4 of FIG. 4. This embodiment of the module 92 may be advantageous in certain applications.

Corrugations

Figure 26:
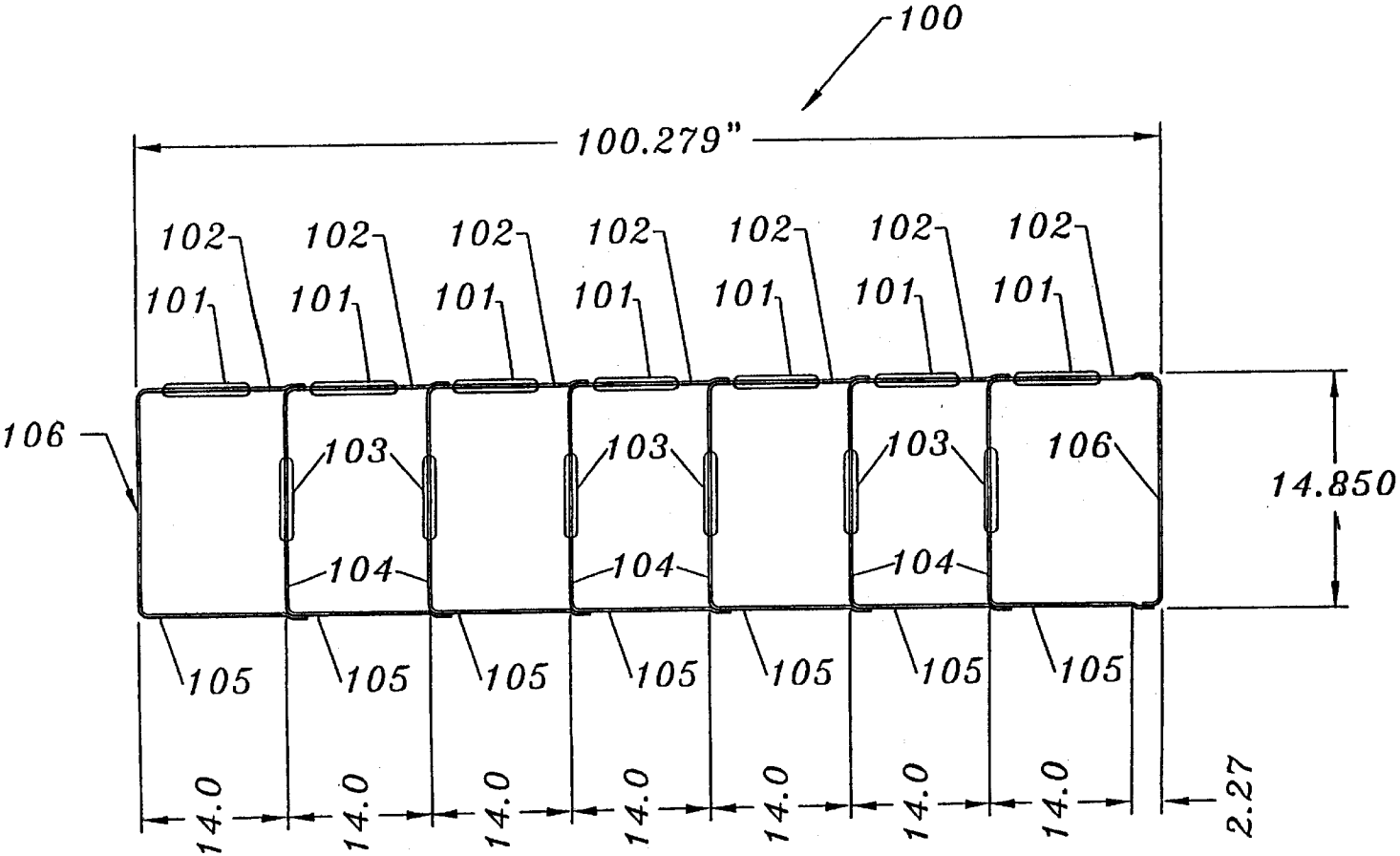
FIG. 26 is an elevational end view schematically illustrating a bridge module formed with the C-shaped sections of FIG. 1 having corrugations at the top flanges and vertical webs.

FIG. 26 illustrates a bridge module 100 that is similar to the module 12 shown in FIG. 3 and is manufactured in substantially the same way except for the addition of corrugations 101 at the top flanges 102 of each section of the module 100 and the addition of corrugations 103 to the vertical webs 104. The bottom flanges 105 do not have any corrugations because they would generally not be needed, as the bottom flanges 105 would generally be under tension under vehicular loading, but may include similar corrugations. The corrugations 101 in the top flanges 102 are useful in strengthening the module 100 against heavy impact of vehicular wheel loads. In addition, the corrugations 101 may make it possible to reduce the thickness of the plate forming the module 100 and thereby reduce the overall weight of the bridge. Similarly, the additional corrugations 103 at the vertical webs 104 resist the vehicular loading, and may have a similar structure as the corrugations 101. No corrugations are provided at the two end vertical webs 106 to facilitate joining bridge modules together and to facilitate connection to guardrail posts with the generally flat outside surface.

Examples of corrugations are found in U.S. Pat. No. 4,251,973 to Paik, which is incorporated herein by reference in its entirety.

Figure 27:
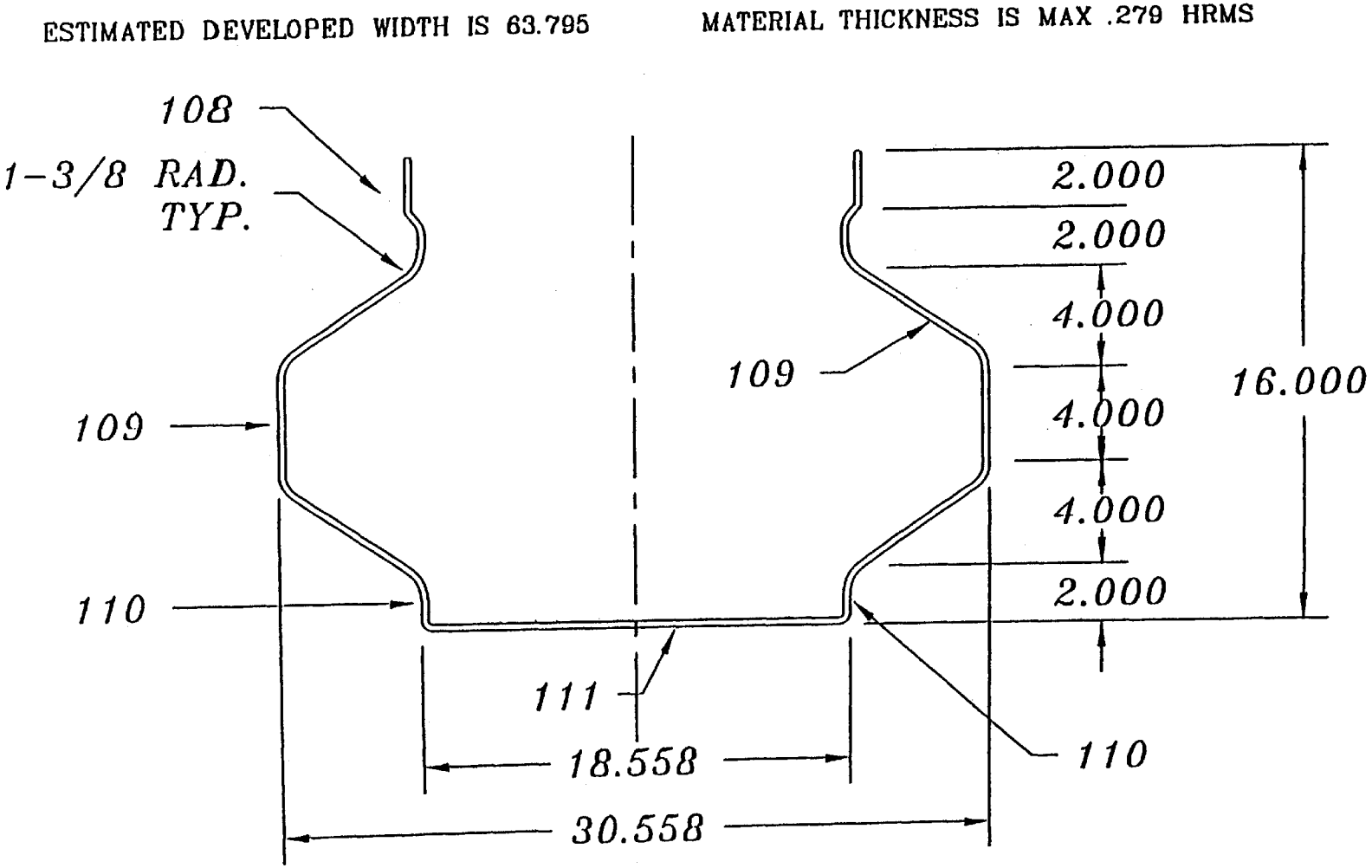
FIG. 27 is an elevational view schematically illustrating another embodiment of the C-shaped section having larger trapezoidal corrugations on the top and bottom flanges.

FIG. 27 shows a C-shaped section 108 having a large trapezoidal corrugation 109 on the top and bottom flanges 110. The trapezoidal profile 109 may typically be about 6", deep by 16" pitch. The C-shaped section 108 is manufactured by roll-forming the 6" by 16" corrugation 109 into the flat plate 25 of FIG. 5 before it enters the corrugator 26 to be turned into the C-shaped section 108. A plurality of the corrugated sections 108 are assembled together. The dimensions shown in FIG. 27 are for illustrative purposes only, and are not meant to restrict the scope of the invention. A variation of this style of bridge module may also be manufactured where only the top chord is corrugated and the bottom chord is flat. Again, the top chord experiences the more destructive loading.

Figure 28:
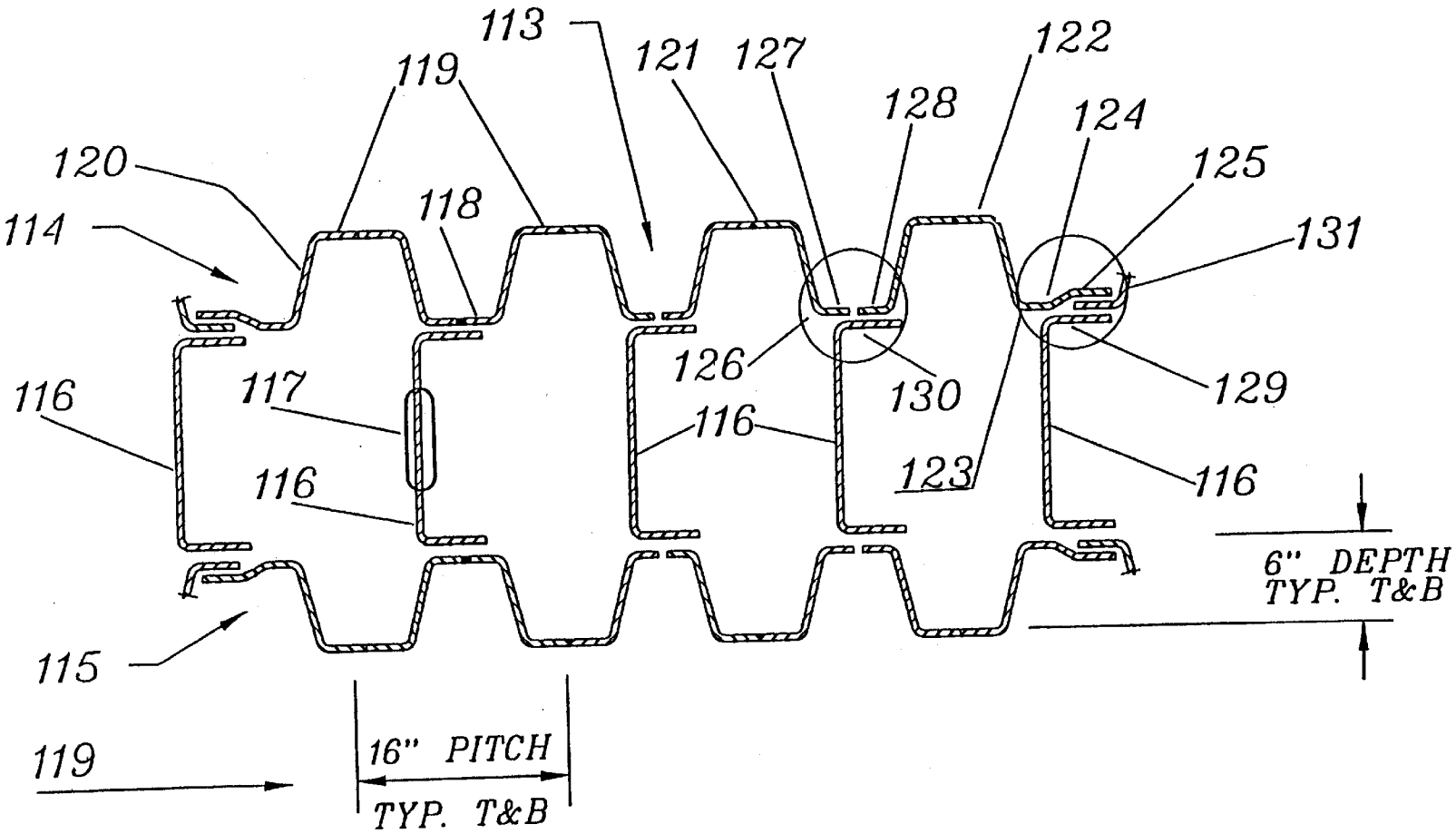
FIG. 28 is an elevational view schematically illustrating a portion of a bridge module formed with C-shaped sections separating the top and bottom trapezoidal shaped corrugated members.

Referring to FIG. 28, a corrugated bridge module 113 is similar in appearance to one assembled with the C-shaped sections 108 of FIG. 27, except that the sections in the module 113 each have three corrugated components: a 6" deep by 16" pitch corrugated bridge deck (flooring) plate 114, a corresponding bottom corrugated plate 115, and a C-shaped web channel 116. These three components may be fabricated to form an MCBGB (Multi-Cell Box Girder Bridge) Short Span Bridge System. The web channels 116 may have corrugations 117 formed therein to further strengthen the webs 116. The top corrugated bridge deck 114 in this embodiment has three styles of 6" deep by 16" pitch corrugations 119, 121, 122. These plates 120 with the double corrugation 119 may have a net coverage of about 32". The next two corrugations 121, 122 to the right are single-pitch corrugations each having a 16" net coverage. Two circles 123, 126 show two different style connections that can be used to weld these single-pitch corrugations to the underlying flanges 129, 130. In the connection shown in the circle 123, a lap 125 is provided to facilitate the creation of a fillet weld to join the two lips 125, 131 together. Plug welds (not shown) provided in the valley of the corrugation weld the two lips 125, 131 to the flange 129 of the web 116. The bottom chord 115 of the bridge module 113 may be flat with no corrugations. The fabrication of the MCBGB requires all the plates to be welded together and steps to secure them in a fixture for welding. The process is more laborious than the methods of joining shown in FIGS. 1–17. Again, the dimensions shown in FIG. 28 are for illustrative purposes only. Details of similar corrugations are disclosed in U.S. Pat. No. 4,120,065 to Sivachenko and Broacha, which is incorporated herein by reference in its entirety.

Multiple Module Bridge System

Figure 31:
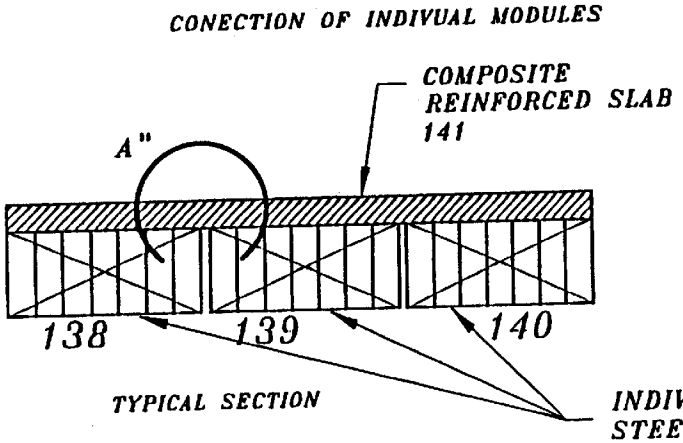
FIG. 31 is an elevational view schematically illustrating another embodiment of a multi-cell box girder bridge having three modules joined together by a composite reinforced slab.
Figure 32:
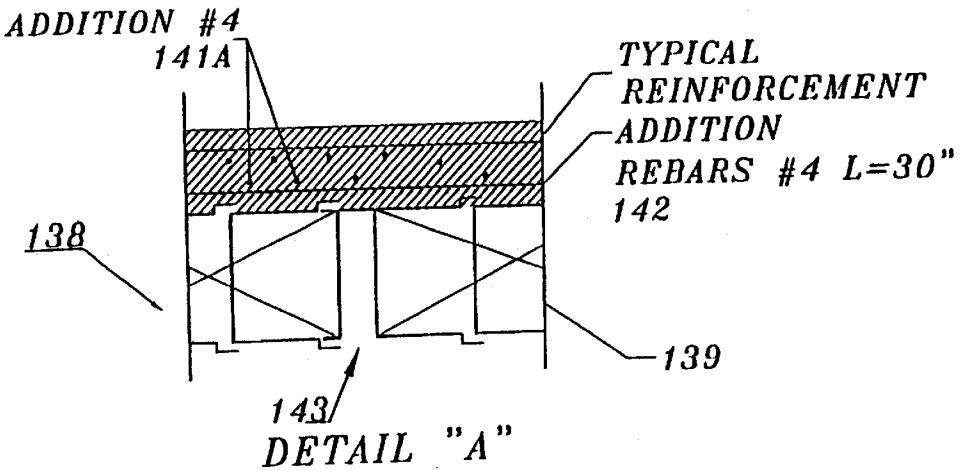
FIG. 32 is an elevational view schematically illustrating the details of the structure of the joined modules of FIG. 31.

FIG. 31 illustrates an MCBGB comprising three modules 138, 139, 140 that are joined together by a composite reinforced slab 141. As shown in FIG. 31, the middle module 139 is spaced from adjacent modules 138, 140 by an open space on each side. The detail "A" in the circled region is seen more clearly in FIG. 32, which shows how the adjacent modules 138, 139 are typically joined structurally to withstand wheel impact loads moving from one module across to the next adjacent module. Additional reinforcing bottom mats 141A, 142 are provided over the modules 138, 139 and across the unjoined area or gap between the two modules 138, 139. The bottom mats 141A, 142 may include, for example, ½" diameter bars of #4 reinforcing steel. The additional reinforcement mats 141A, 142 add structural strength to the two modules 138, 139. Typically, the mat 141A includes reinforcing steel bars that are disposed parallel to the longitudinal axis of the bridge modules 138, 139 and span the full length of the modules 138, 139. The mat 142 includes reinforcing steel bars that are Generally perpendicular to the longitudinal axis of the modules 138, 139. The bars of the mat 142 are typically about 30" long, spanning over across the area of the separation 143 between the two modules 138, 139. The same reinforcement structure is formed over the two modules 139, 140. The top is a roadway or traffic carrying surface covering the mats 141A, 142.

Flat Bridge Deck Surface

Figure 33:
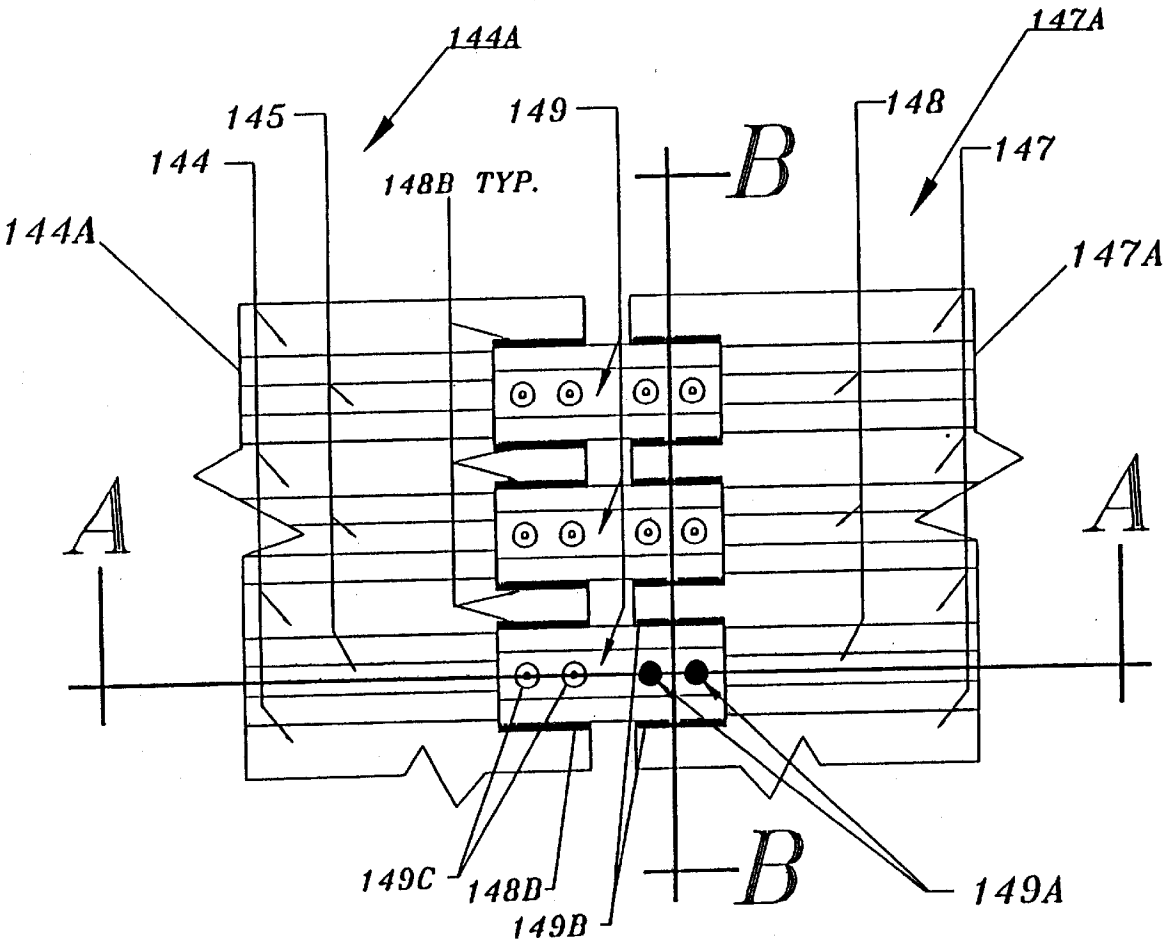
FIG. 33 is a top plan view schematically illustrating the connection of two bridge modules to form a flat corrugated bridge deck surface.
Figure 35:
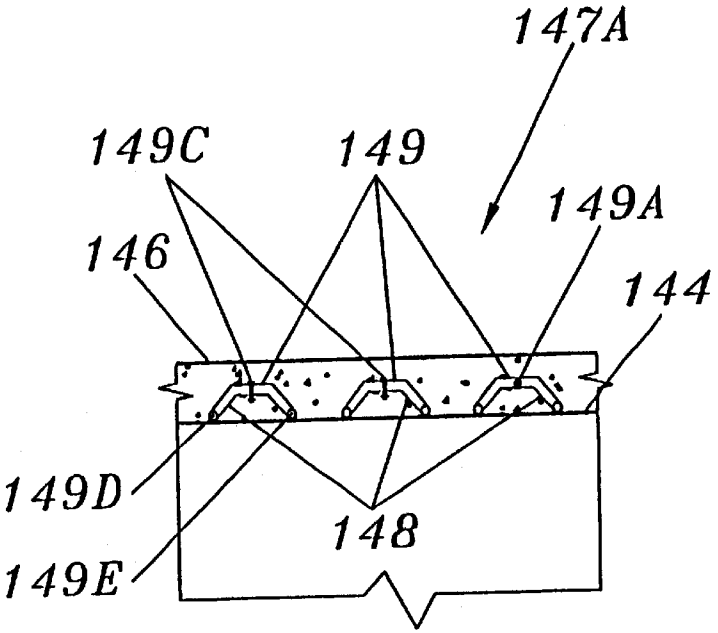
FIG. 35 is a cross-sectional view along B—B of the connection of the bridge modules of FIG. 33.
Figure 34:
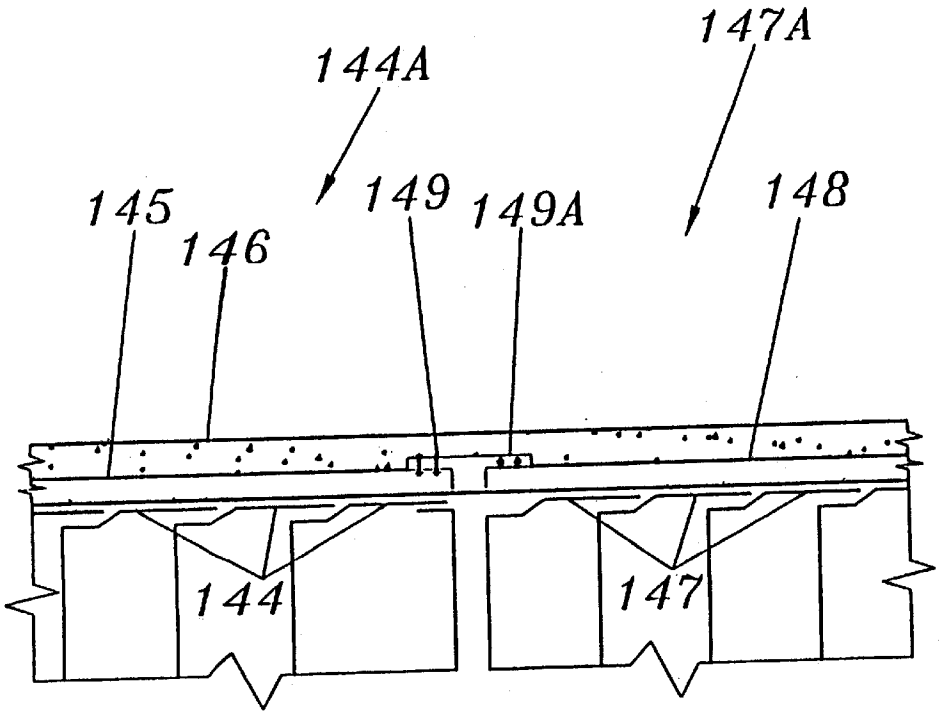
FIG. 34 is a cross-sectional view along A—A of the connection of the bridge modules of FIG. 33.

FIGS. 33–35 illustrate a flat bridge deck surface that is compatible with the generally flat top surface 98 of the bridge module 92 of FIG. 25. Referring to FIG. 33, two adjacent bridge modules 144A, 147A are connected together. The module 144A has a bridge deck 144 and the module 147A has bridge deck 147. A trapezoidal bridge flooring 145 is welded down to the bridge deck 144 and another trapezoidal bridge flooring 148 is welded down to the bridge deck 147. The bridge floorings 145, 148 each act as a bond to hold the bituminous or concrete fill (not shown) on the bridge decks 144, 147, respectively. Relatively short sections of bridge flooring 149 are overlapped with the bridge floorings 145, 148 to join them together structurally with plug welds 149A and/or fillet welds 148B and/or bolts 149C. The overlapping structure is able to withstand separating forces between the two bridge decks 144A, 147A caused by wheel impact loads.

The A—A section in FIG. 34 more clearly shows the connection between the two bridge modules with a bituminous fill to resist vehicular impact loads across from one module to the next module. The left module 144A has the bridge flooring 145 connected structurally to the bridge flooring 148 of the right bridge module 147A by the short piece of bridge flooring 149 that nests into the tops of the two aligned ends of the bridge floorings 145, 148. The bridge floorings 145, 148 are welded to the flat surfaces 144, 147 of the bridge along the full width of the decks 144A, 147A.

The section B—B in FIG. 35 taken from FIG. 33 shows the relatively short sections of the bridge flooring 149 installed on top of the individual bridge floorings 148 by bolting with bolts 149C or by making plug welds at the top 149A and/or by welding at the base 149D to the bridge deck 144 or to the base 149E of the bridge flooring 148.

Figure 37:
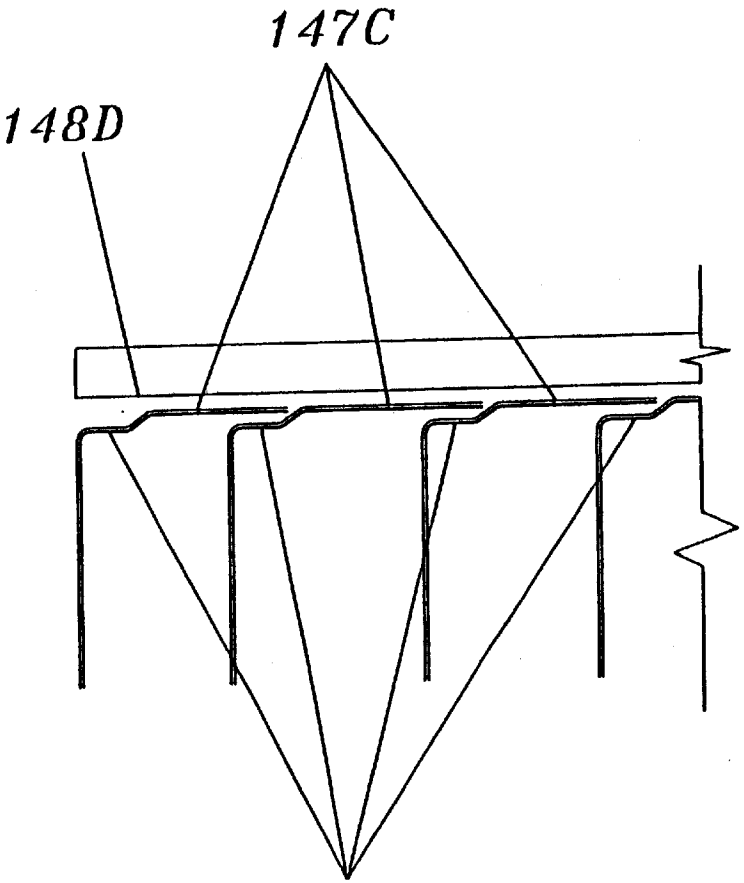
FIG. 37 is an elevational view schematically illustrating another embodiment of a side portion of a multi-cell box girder bridge.
Figure 36:
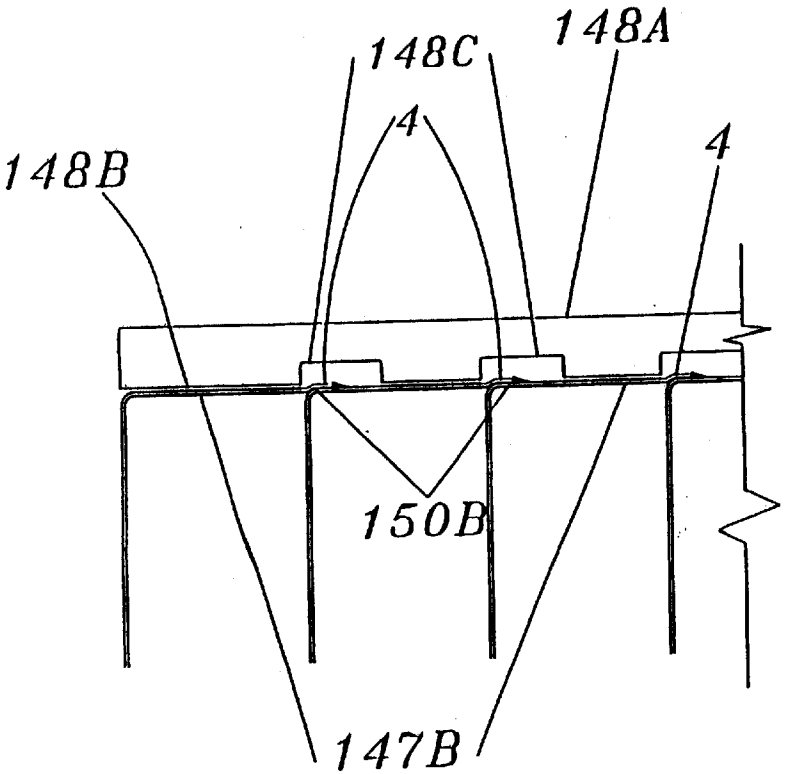
FIG. 36 is an elevational view schematically illustrating an embodiment of a side portion of a multi-cell box girder bridge.

FIG. 36 shows a section of bridge flooring 148A having bottom lips 148B with notches 148C over the area of the double lap 150B so that the bridge flooring 148A rests flat on the steel deck 147B of the MCBGB system. This configuration is compatible with the module 12 of FIGS. 3 and 4 with the overlapping lips 4 that protrude above the flat deck. The notches 148C allow the notched bridge flooring 148A to rest flat on the steel deck 147B to create the flat bridge deck surface. In FIG. 37, the double laps 150C are recessed as those shown in FIGS. 25 and 33–35. As a result, the bridge flooring lips 148D rest flat on the flat steel deck 147C of the MCBGB without the need for notching.

Support Plates

Figure 38:
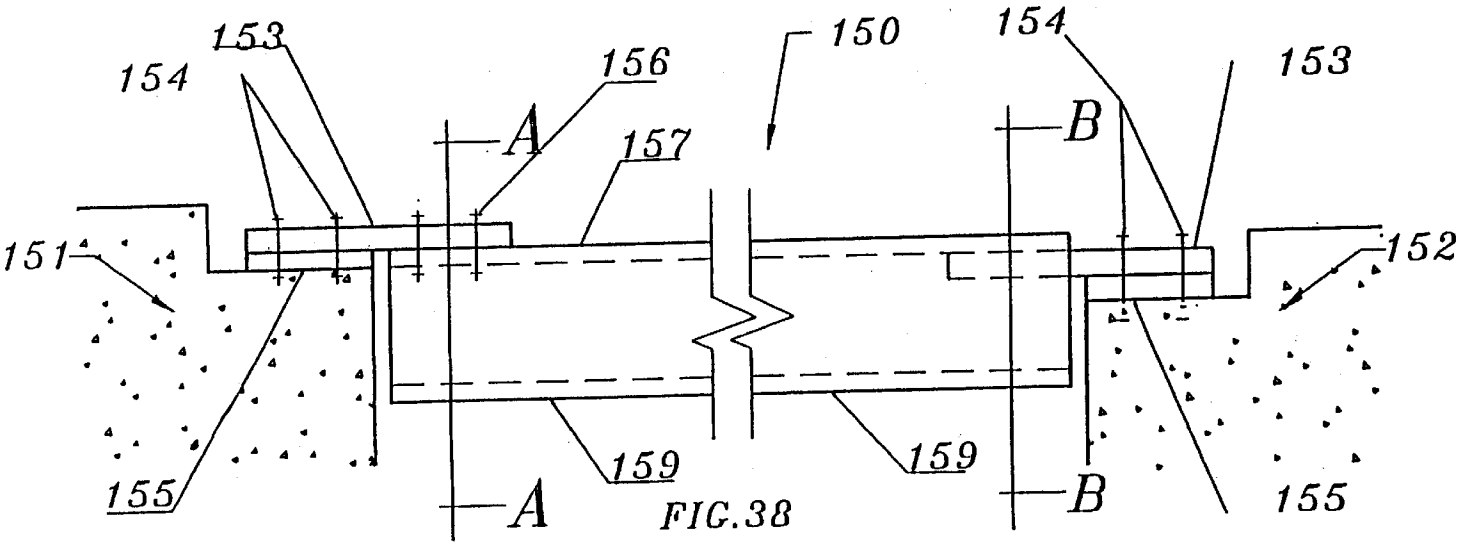
FIG. 38 is an elevational side view schematically illustrating a multi-cell box girder bridge system supported between two abutments of the present invention.
Figure 39:
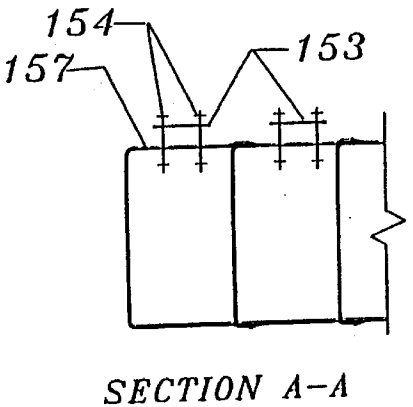
FIG. 39 is a cross-sectional view along A—A of the bridge of FIG. 38 schematically illustrating the bolting of support plates to the deck of the bridge.

In FIG. 38, an MCBGB system 150 spans between two abutments 151, 152. A steel plate 153 is fastened with anchor bolts 154 to the left abutment 151 and another steel plate 153 is fastened with anchor bolts 154 to the right abutment 152. Elastomeric bearing pads 155 may be installed between the abutments 151, 152 and the support plates 153. The support plates 153 may comprise steel. At the left abutment 151, bolts 156 are provided to couple the support plate 153 to the top steel deck 157 of the bridge system 150. Welding may be used instead of the bolts 156 for the connection. In addition, the support plates 153 may be in the form of other structural members, such as sections of bridge flooring welded to the support plates 153 and tubing (not shown), for one of skill in the art. In the section A—A in FIG. 39 taken from FIG. 38, the plates 153 are bolted to the top of the left-end of the steel deck 157 of the MCBGB system 150. This connection may be made by welding instead of the bolts.

Figure 40:
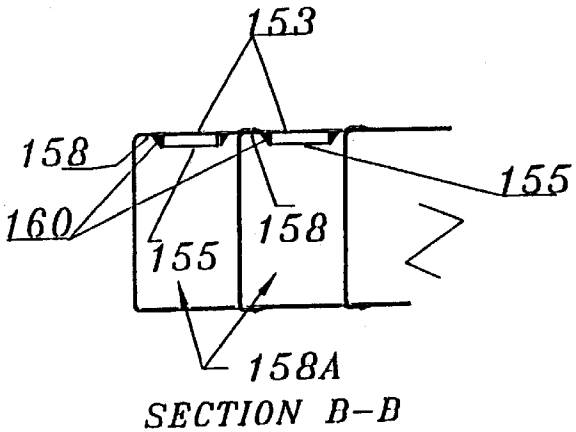
FIG. 40 is a cross-sectional view along A—A of the bridge of FIG. 38 schematically illustrating the welding of support plates to the deck of the bridge.

Referring to FIG. 38, the right abutment 152 has support plates 153 that are welded internally inside a top inner surface 158 of each of the box girder cells. This connection can be made by bolting rather than welding. The support plates 153 are attached to the right abutment 152 in a manner similar to the attachment at the left abutment 151. This method of connecting the bridge 150 to the abutments 151, 152 allows the bridge 150 to be shorter than in other types of connections. Therefore, the bridge 150 weighs less and is easier to ship. The top of the bridge 150 is at a lower elevation than that for a bridge having a bottom 159 supported on top of the abutments 151, 152 on which the support plates 153 are disposed. A lower elevation may be advantageous for some applications. In the section B—B of FIG. 40, the right support plates 153 are welded along welds 160 to the top interior 158 of the bridge cell 158A.

Cable Stayed and Arch Bridges

Figure 41:
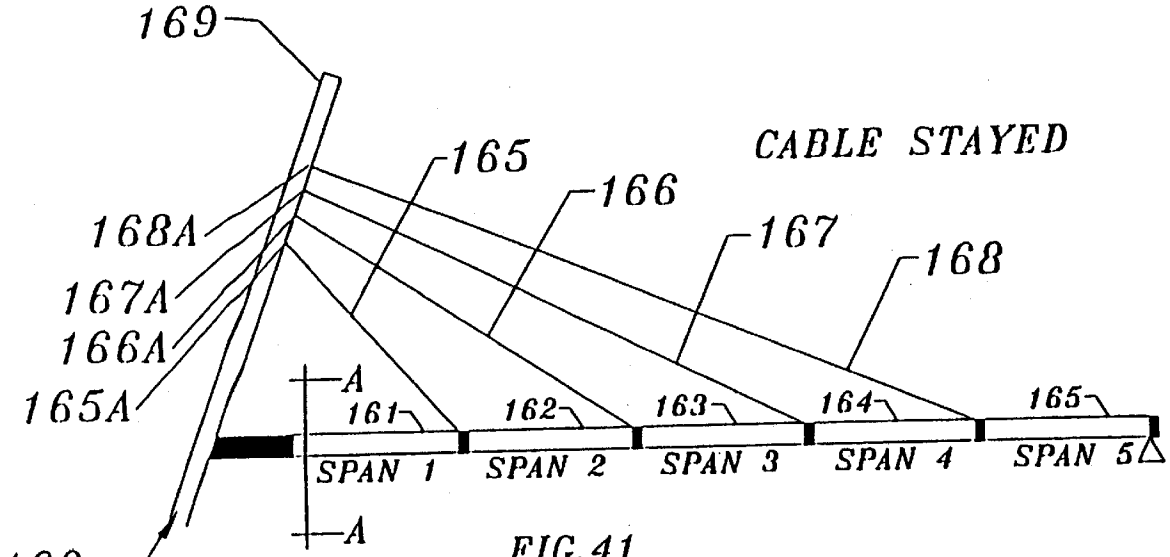
FIG. 41 is an elevational view schematically illustrating a cable stayed bridge employing the multi-cell box girder bridge modules of the present invention.

FIG. 41 shows a cable stayed bridge that can cover much greater clear spans at substantial cost savings, particularly with light structures such as the MCBGB system of the present invention that is made of steel rather than the much heavier concrete structures. A span 161 is supported at the left end by a bridge tower 169 that is generally anchored into the ground. A span 162 is supported at its left end by a cable 165 and at its right end by a cable 166, etc., and a span 165 is supported at its left end by a cable 168 and at its right end by the ground or a ground structure. The cables 167A, 166A, and 165A are anchored into the ground.

Figure 43:
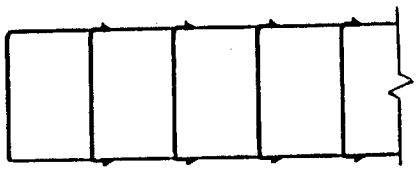
FIG. 43 is a cross-sectional view along A—A of the bridges of FIGS. 41 and 42 schematically illustrating the sections forming the multi-cell box girder bridge module.
Figure 42:
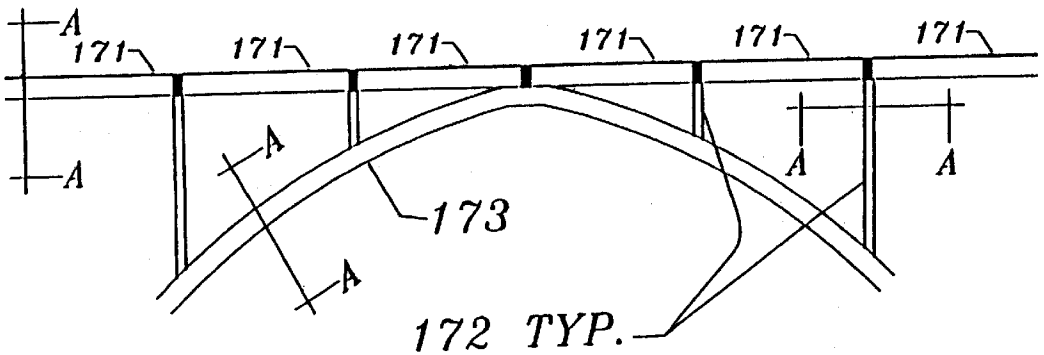
FIG. 42 is an elevational view schematically illustrating an arch bridge employing the multi-cell box girder bridge modules of the present invention.

In FIG. 42, an arch bridge employs the MCBGB module sections for making supporting spans 171, vertical columns 172, and a supporting arch 173. The construction of the arch bridge using the module sections is more economical than conventional construction. FIG. 43 illustrates an A—A section that may be taken from either the representative span 161 of the cable stayed bridge of FIG. 41, or the representative arch 173, column 172, or span 171 of the arch bridge of FIG. 42.

Various MCBGB Systems

Figure 44:
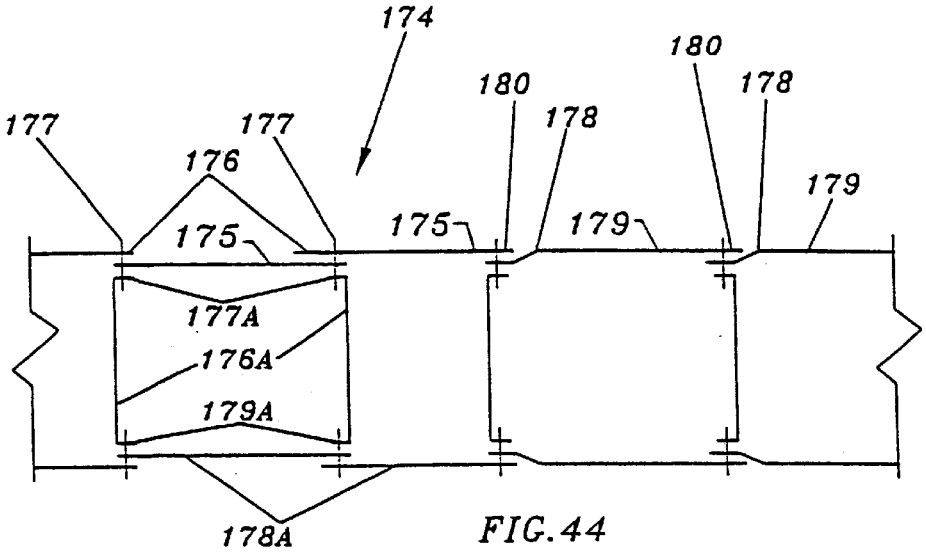
FIG. 44 is an elevational view of an embodiment of an orthotropic-type multi-cell box girder bridge system of the present invention.
Figure 45:
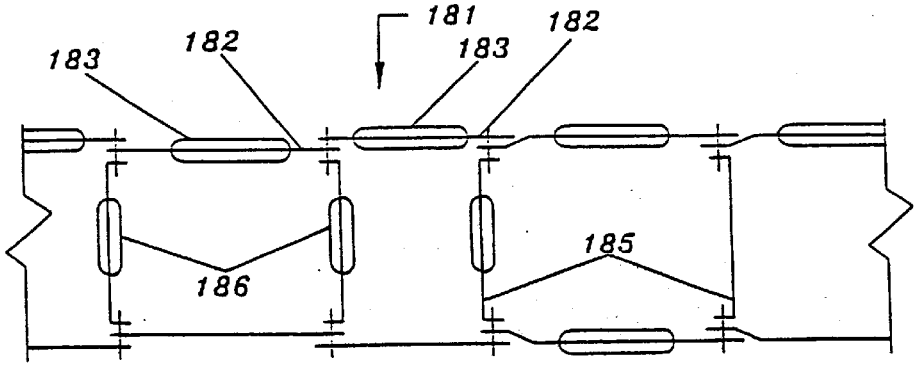
FIG. 45 is an elevational view of another embodiment of the orthotropic-type multi-cell box girder bridge system having strengthening corrugations.
Figure 46:
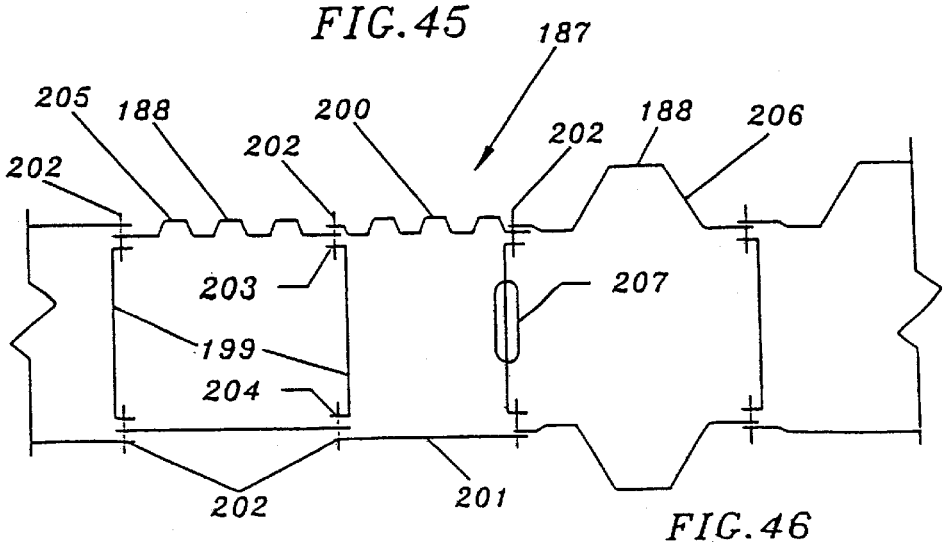
FIG. 46 is an elevational view of another embodiment of the orthotropic-type multi-cell girder bridge system having bridge flooring type corrugations.

FIGS. 44–46 show different embodiments of MCBGB systems which comprise steel plates. The three embodiments have bolted connections for simple field assembly or partial shop welding to make modules that are relatively small and light for easy field assembly with minimum equipment.

In FIG. 44, an orthotropic-type MCBGB system 174 is made with flat steel plates and includes top flat plates 175 for supporting a road surface made of materials such as concrete or asphalt. The edges 176 of the plates 175 have holes punched therein. An underlying channel 176A has a prepunched top flange 177A. Bolts 177 join the flat plates 175 through the holes with the prepunched top flange 177A. Similarly, the bottom of the bridge system 174 is assembled with prepunched flat plates 178A that are bolted to the prepunched bottom flange 179A of the supporting vertical channel or webs 176A. The left ends 178 of the top flat plates 179 are offset by an amount about equal the thickness of a connecting plate 180. As a result, the top surface of the bridge system 174 is substantially flat and installation of a bridge flooring on top of the steel deck of the bridge system 174 does not require notching such as that shown in FIG. 36.

The bridge 181 in FIG. 45 is substantially the same as the bridge 174 of FIG. 44 except that the top plates 182 are provided with corrugations 183 that run at right angles to the longitudinal axis or span of the bridge. The corrugations 183 increase the strength of the plates 182 between the supporting vertical channels or webs 185 of the bridge 181. The webs 185 may be further strengthened by forming vertical corrugations 186 therein. By increasing the overall strength of the bridge 181 with the corrugations 183, 186, the metal thickness of the plates 182, 185 may be reduced, thereby reducing the overall weight of the bridge 181 and of the individual components that need to be installed in the field.

FIG. 46 shows an MCBGB 187 that is similar to those of FIGS. 44 and 45. In this embodiment, the top steel deck may have bridge flooring-type corrugations 188 roll-formed before assembly into the top plates parallel to the longitudinal axis of the bridge 187 and/or combinations (not shown) with the bridge flooring corrugations 188 running at right angles to the longitudinal axis of the bridge 187. Channel webs 199 separate the top chord 200 and bottom chord 201, and are bolted using bolts 202 to the top and bottom cords 200, 201, respectively, through the top flange 203 and the bottom flange 204. The bridge flooring 188 may be a shallow corrugation 205 that is, for example, 2" deep by 6" pitch (shown at the left), or a deep corrugation 206 that is, for example, 6" deep by 16" pitch (shown at the right). The channel webs 199 may have corrugations 207 as well.

Installation of MCBGB System

Figure 47:
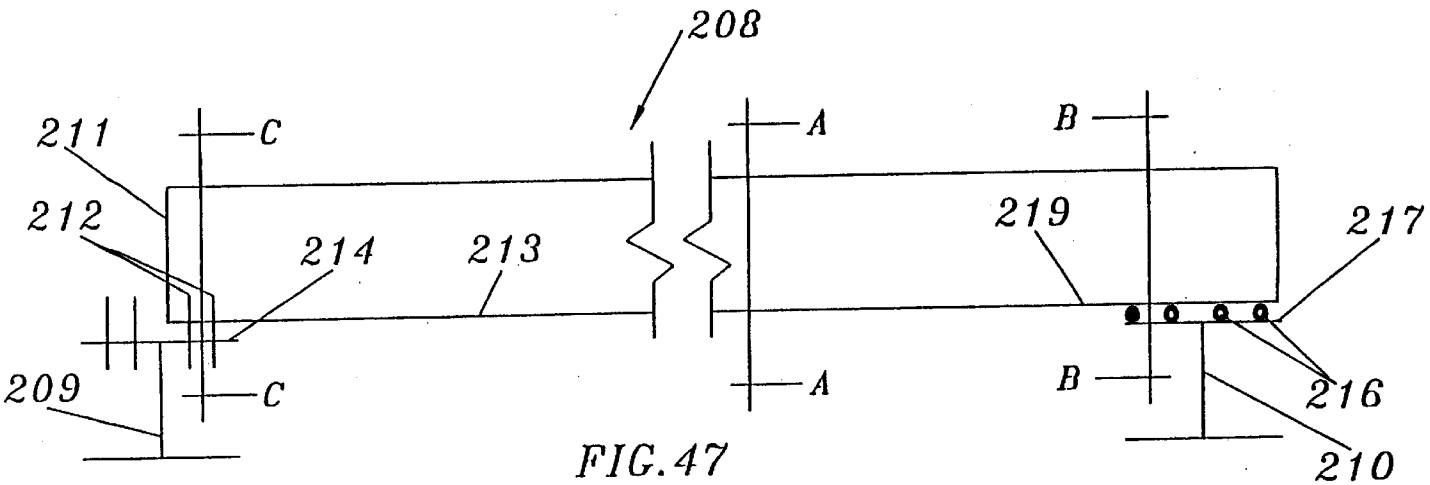
FIG. 47 is an elevational view of a multi-cell box girder bridge supported between two wideflange beams of the present invention.

FIG. 47 shows an MCBGB 208 that spans between two existing or new wideflange beams 209, 210. The left end 211 of the MCBGB 208 is bolted from the interior 213 of the MCBGB 208 to the top 214 of the wideflange beam 209 upon which the MCBGB rests. The right end 215 is welded along weld 216 to the top 217 of the wideflange beam 210. The welds 216 may be plug welds made inside the MCBGBs 208, and join the MCBGBs 208 to the wideflange beam 210.

Figure 50:
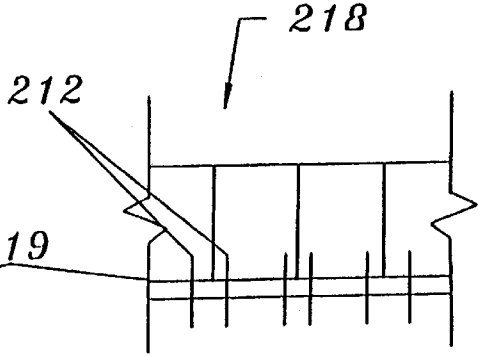
FIG. 50 is a cross-sectional view along C—C of the bridge of FIG. 47 schematically illustrating the bolting connection between the bridge and the wideflange beams.
Figure 49:
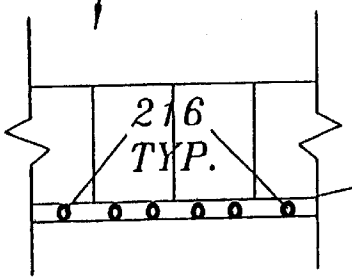
FIG. 49 is a cross-sectional view along B—B of the bridge of FIG. 47 schematically illustrating the interior plug welds.
Figure 48:
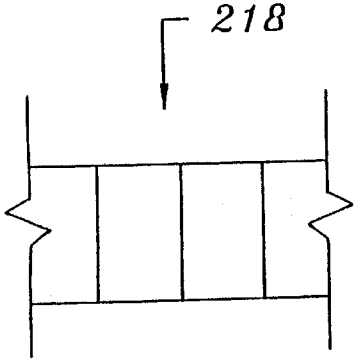
FIG. 48 is a cross-sectional view along A—A of the bridge of FIG. 47 schematically illustrating the structure of the bridge.

The section A—A of FIG. 48 shows a cross section 218 that illustrates the multi-cell structure of the MCBGB 208 of FIG. 47. The section B—B 218 in FIG. 49 is taken from FIG. 47 and shows the right end 215 and interior plug welds 216 joining the interior bottom 219 to the top 217 of the exterior wideflange beam 210. Another method of joining the bottom 219 to the top 217 of the immediate underlying wideflange beam 210 is to punch elongated holes (not shown) at the bottom 219 (instead of the bolt holes) so that these holes would be suitable to be plug-welded to the MCBGB 208 to the wideflange beams 210. FIG. 50 shows a section C—C that illustrates how the bolts 212 join the bottom 219 of the MCBGB 208 to the top of the exterior wideflange beam 217.

Figure 51:
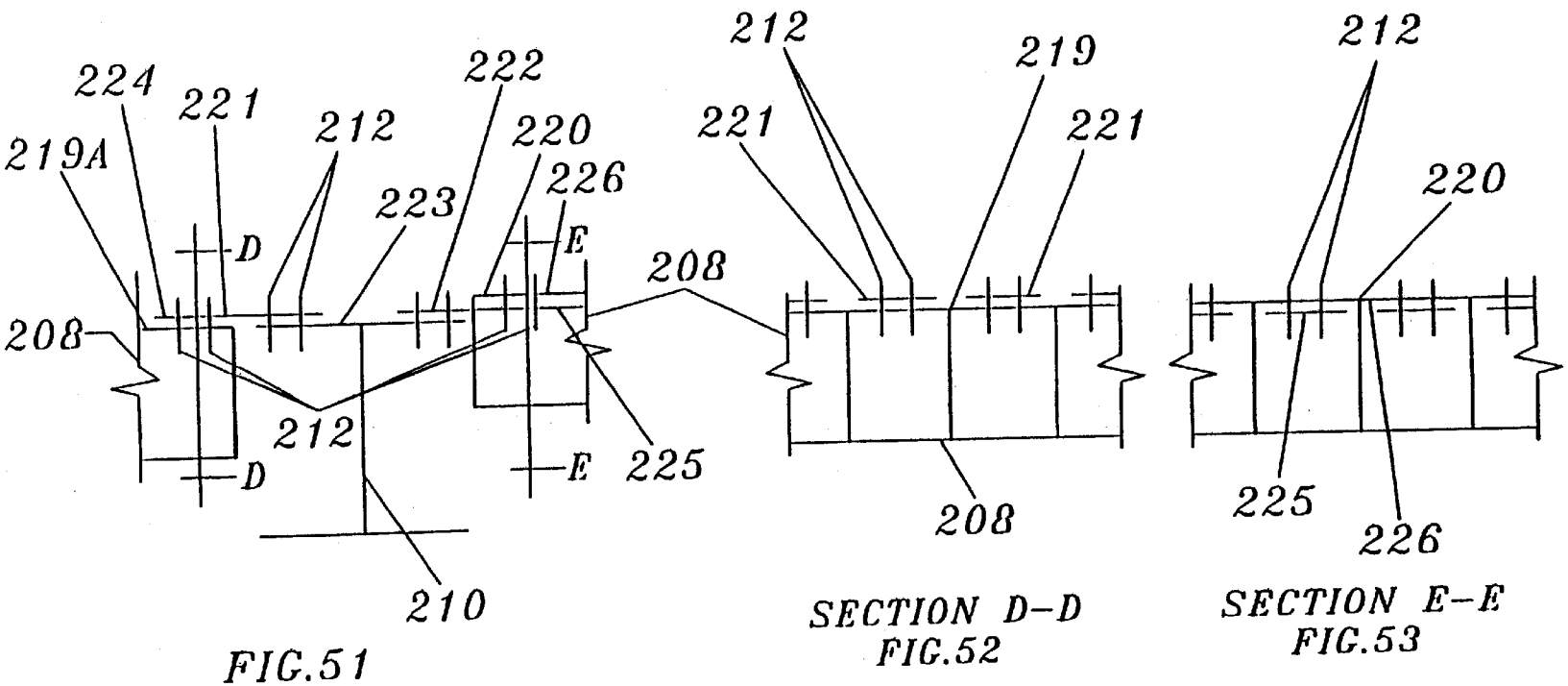
FIG. 51 is an elevational view schematically illustrating a bridge system formed by connecting two multi-cell box girder bridge modules by bolting.

Referring to FIG. 51, two MCBGBs 208 have their two top ends 219A, 220 connected by bolts 212 to their respective support plates 221, 222, which in turn are connected by bolting or welding (not shown) to the common top 223 of an exterior support wideflange beam 210 between the support plates 221, 222. The left end 224 of the left support plates 221 is connected by bolts 212 to the exterior top of the left end 219A of the left MCBGB. Conversely, the right end 225 of the right support plates 222 is connected by bolts 212 into the top interior 226 of the top end 220 of the right MCBGB.

FIG. 52 shows a section D—D of the left MCBGB 208 illustrating the connection of the exterior support plates 221 to the top 219 of the MCBGB 208. The section E—E taken from FIG. 51 and shown in FIG. 53 illustrates the connection at the top end 220 of the right MCBGB 208 between the exterior support plates 225 and the interior 226 of the right MCBGB 208 by bolts 212.

Figure 54:
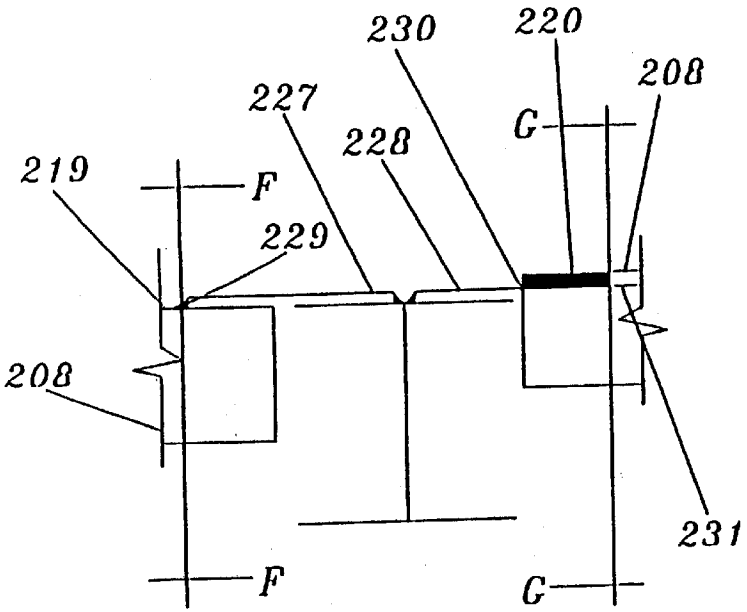
FIG. 54 is an elevational view schematically illustrating a bridge system formed by welding two multi-cell box girder bridge modules to one common supporting beam.

FIG. 54 illustrates two MCBGBs 208 having their two top ends 219, 220 welded with welds 229, 230 respectively to ends of support plates 227, 228. The left support plate 227 is welded externally, and the right support plate 228 is welded internally, to the MCBGBs 208. The interior weld 230 at the right side runs parallel to the longitudinal axis of the MCBGB 208 joining the sides as well as the ends of the interior portions of the support plates 228 to the interior 231 of the right MCBGB 208.

Figure 56:
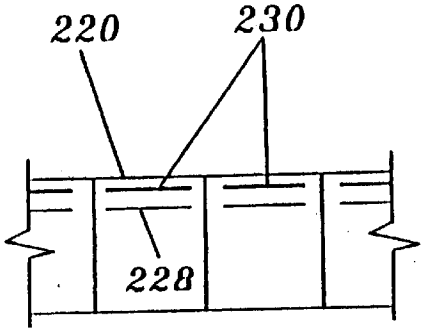
FIG. 56 is a cross-sectional view along G—G of the bridge system of FIG. 54 schematically illustrating another embodiment of the welds joining the one bridge module to a supporting beam.
Figure 55:
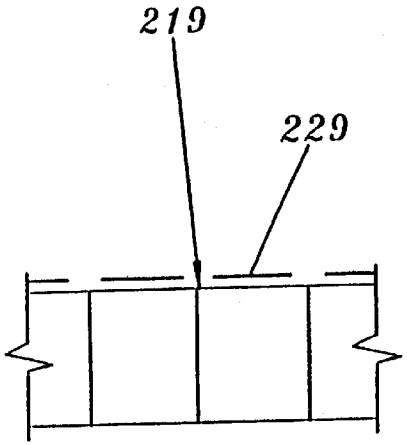
FIG. 55 is a cross-sectional view along F—F of the bridge system of FIG. 54 schematically illustrating an embodiment of the welds joining one bridge module to a supporting beam.

FIG. 55 is a section F—F of FIG. 54 illustrating the end welds 229 that join the support plates 227 to the top 219 of the left MCBGB 208. In section G—G of FIG. 56 taken from FIG. 54, the end welds 230 join the support plates 228 to the inside top 220 of the right MCBGB 208.

Multi-Cell Modules

Figure 57:
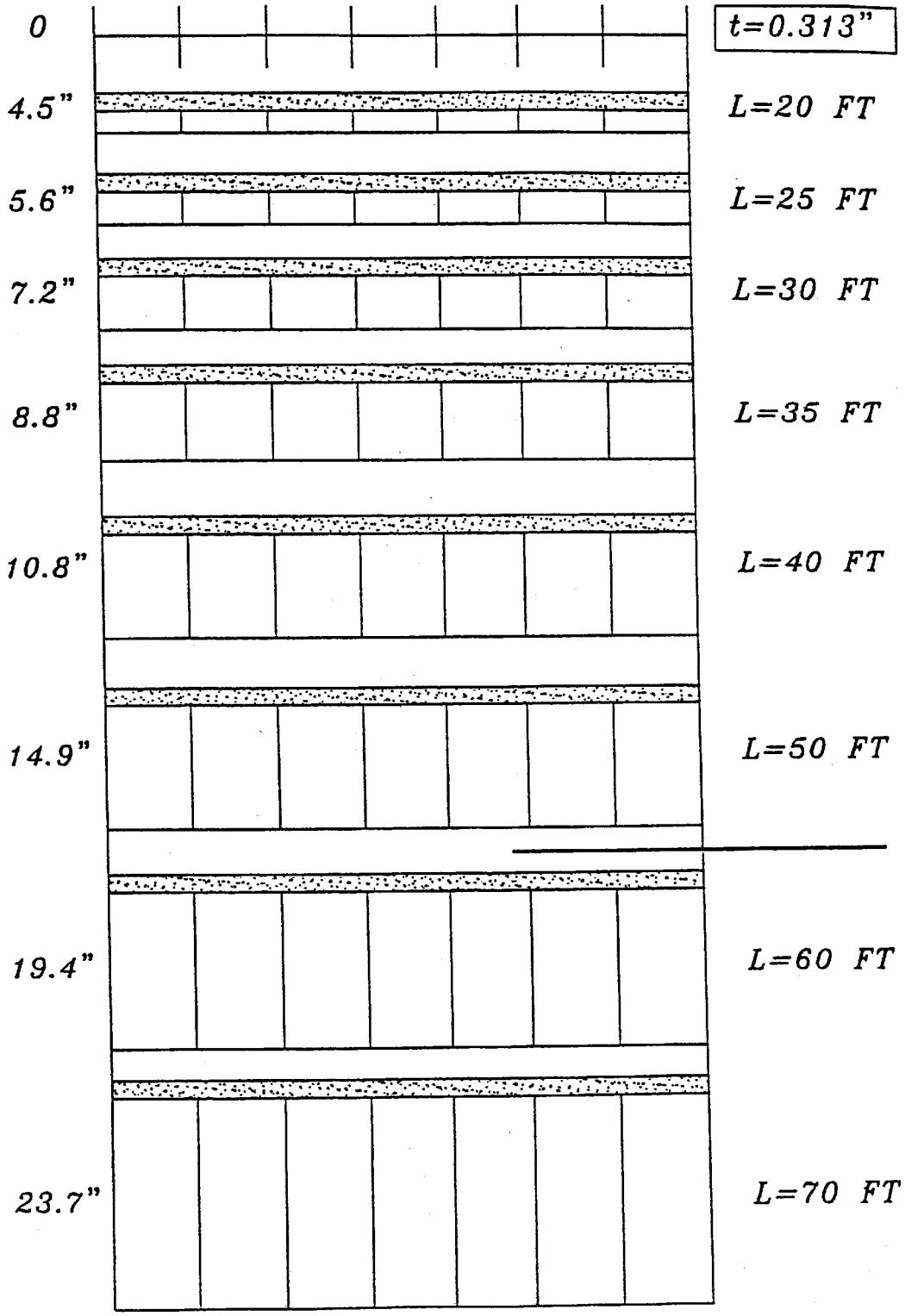
FIG. 57 is an elevational end view schematically illustrating a plurality of preferred embodiments of seven-cell bridge modules having different spans.

FIG. 57 shows a number of examples of seven-cell modules having various lengths or spans (L) and depths (d) for a given thicknesses (t) of about 0.313 inch for HS 25 loading. The depth is the dimension of the generally vertical webs. For a span of about 20 feet, the desired depth is about 4.5 inches. For a span of about 25 feet, the desired depth is about 5.6 inches, and so on. In the last (eighth) illustrated module, the span is about 70 feet and the depth is about 23.7 inches. These examples are provided merely to illustrate examples of different preferred embodiments that are made of steel. An infinite number of other embodiments may be designed to have different spans, thicknesses, and depths.

Figure 58:
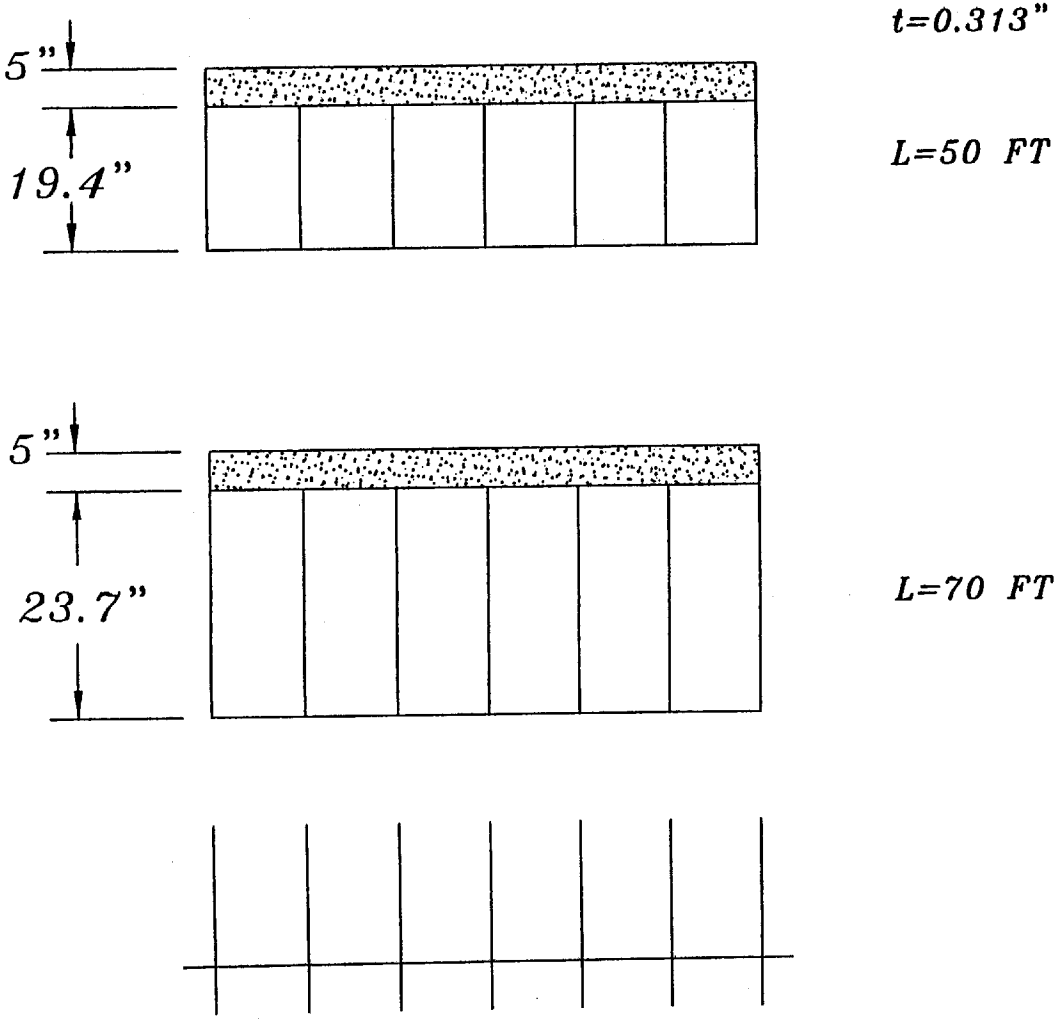
FIG. 58 is an elevational end view schematically illustrating a comparison between a seven-cell bridge module and a six-cell bridge module having the same span.

Referring to FIG. 58, two six-cell modules of the same thickness of 0.313 inch have different spans and depths. The first has a span of 60 feet and a depth of 19.4 inches, and the second has a span of 70 feet and a depth of 23.7 inches. In comparison to the seven-cell modules of FIG. 57, the first six-cell module has the same span and depth as the seventh seven-cell module. The use of the six-cell module requires less material than the use of the seven-cell module for the same span. Similarly, the second six-cell module of FIG. 58 has the same span and depth as the last seven-cell module of FIG. 57. This six-cell module also requires less material to achieve the same span and loading.

It will be noted that these six and seven cell modules have low profiles or depths which is preferable for shipping and installation, as well as end use.

Z-shaped Sections

Figure 59:
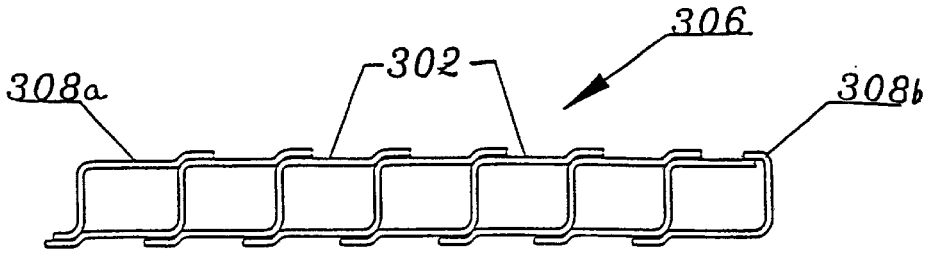
FIG. 59 is an elevational view schematically illustrating a multi-cell bridge module made of Z-shaped sections and L-shaped and J-shaped end sections in accordance with another embodiment of the present invention.

FIG. 59 illustrates Z-shaped sections 302 that can replace the C-shaped sections of FIGS. 1–4. The Z-shaped sections 302 each have a generally vertical web and a pair of generally horizontal members (upper and lower). The Z-shaped sections 302 are combined to form closed cells in a multi-cell module 306, with the generally horizontal members overlapping portions of the neighboring generally horizontal members. An L-shaped end cap 308*a* and a J-shaped end caps 308*b* form closed cells at: the two ends of the module 306 by overlapping with generally horizontal portions. The assembly and application of the module 306 is similar to that for the C-shaped modules.

Arrangement of Multiple Module Bridge Structure

Figure 60:
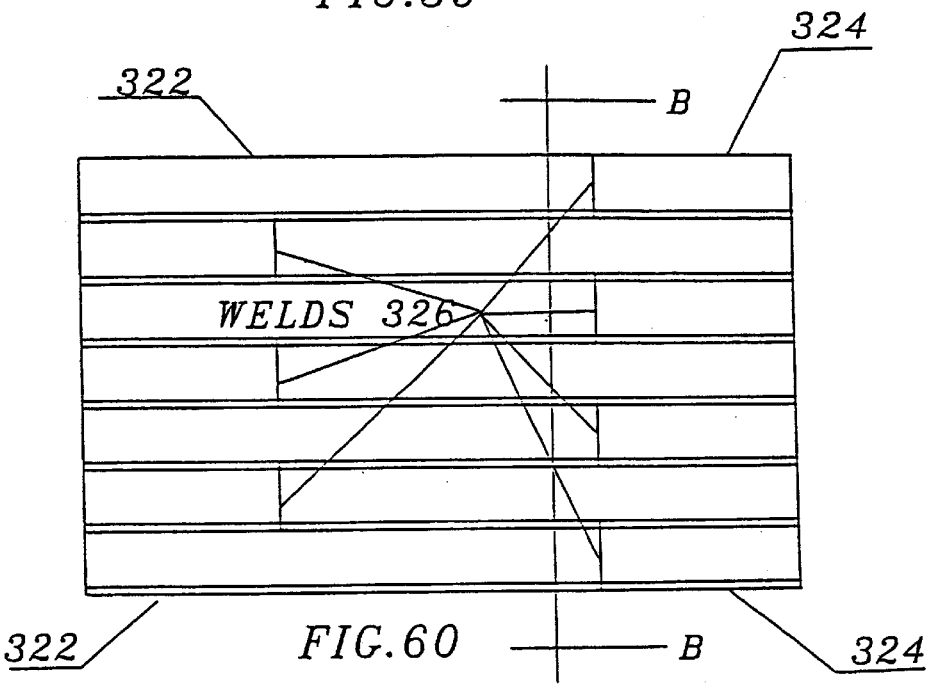
FIG. 60 is a top plan view schematically illustrating a configuration of multiple module sections used for constructing a bridge.
Figure 61:
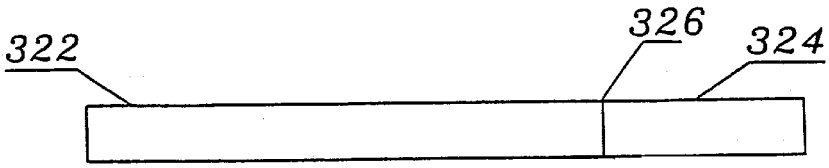
FIG. 61 is a cross-sectional side view along A—A of FIG. 60 schematically illustrating different modules.
Figure 62:
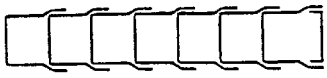
FIG. 62 is a cross-sectional end view along B—B of FIG. 60 schematically illustrating the sections used to build the bridge.

Referring to FIGS. 60–62, an MCBGB system has 14 C-shaped sections welded together to form a bridge. Each row has two sections, a long section 322 and a short section 324, that are welded together at a boundary 326 to achieve the required span of the bridge. The boundaries 326 from row to row are staggered for increased strength. As seen in the cross-sectional view along B—B in FIG. 62, the seven rows of sections are connected in a manner similar to that shown in FIGS. 2–4.

Shear Studs

Figure 63:
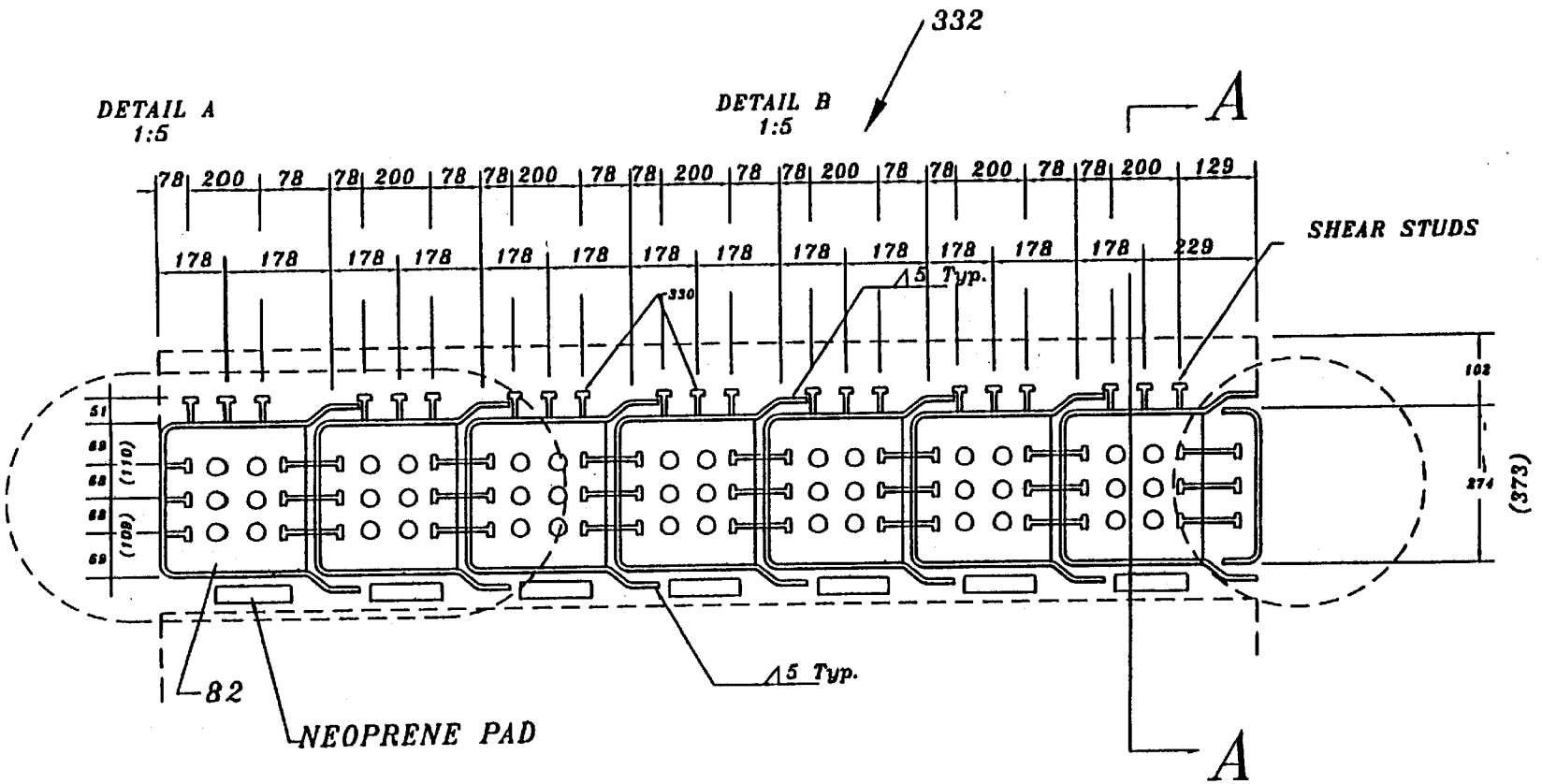
FIG. 63 is an elevational end view schematically illustrating shear studs provided on the surfaces of a multi-cell module.
Figure 64:
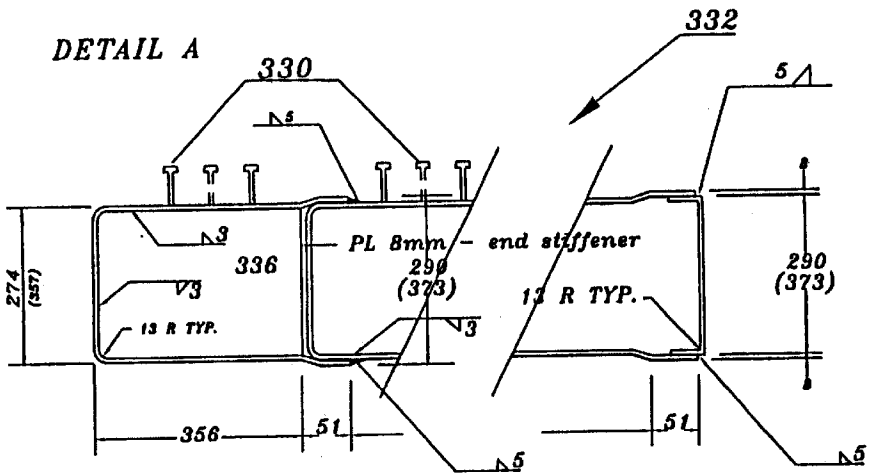
FIG. 64 is a partial elevational end view schematically illustrating the structure of the shear studs at Detail A of FIG. 63.
Figure 65:
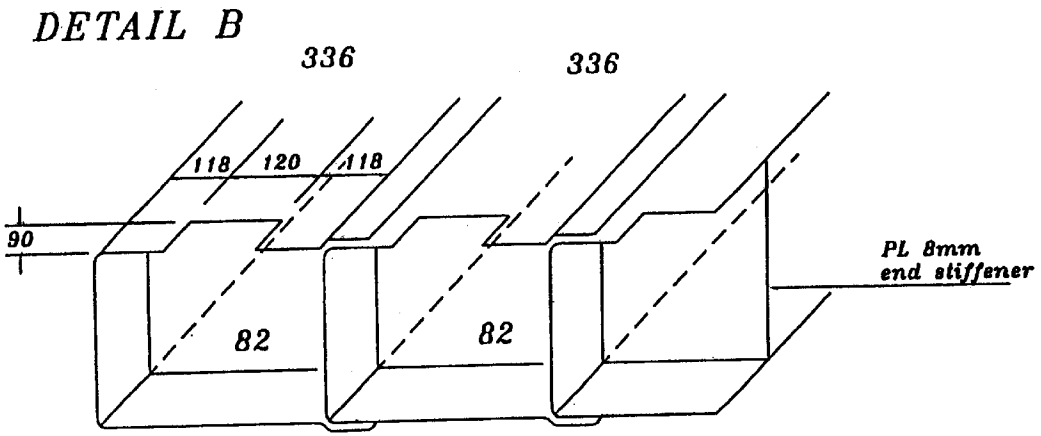
FIG. 65 is a partial perspective view schematically illustrating the structure of the end portion of the bridge module at Detail B of FIG. 63.
Figure 65A:
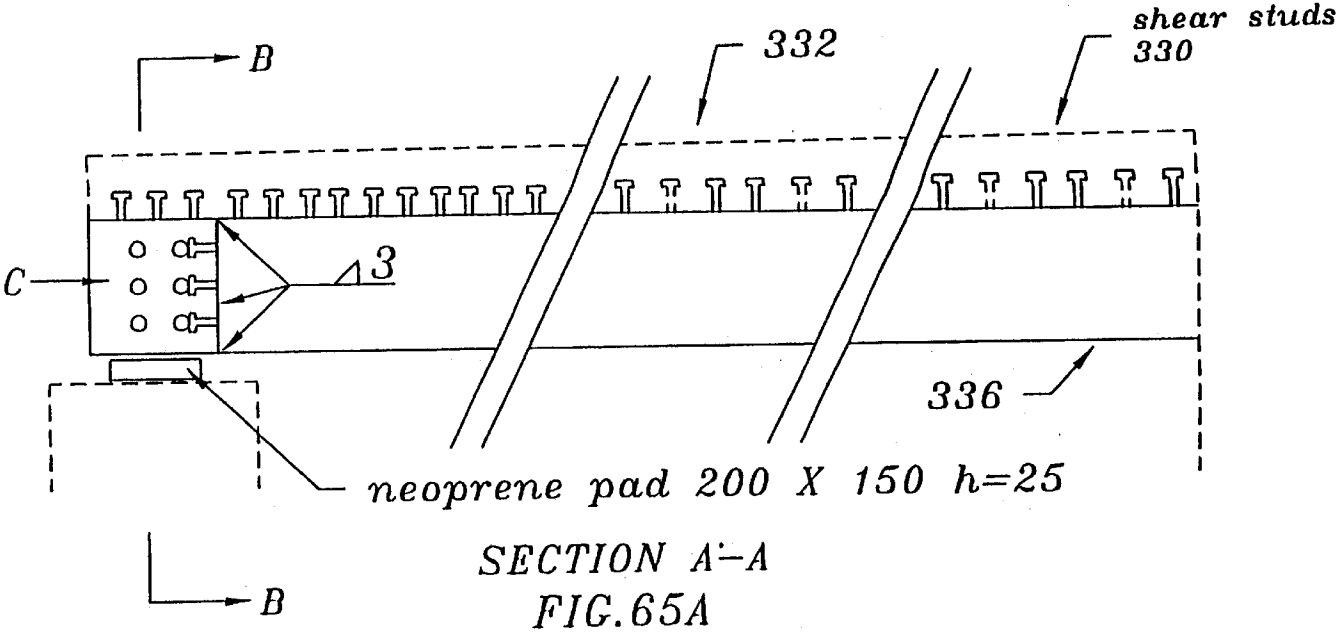
FIG. 65A is a partial cross-sectional view along A—A of the bridge module of FIG. 63.
Figure 65B:
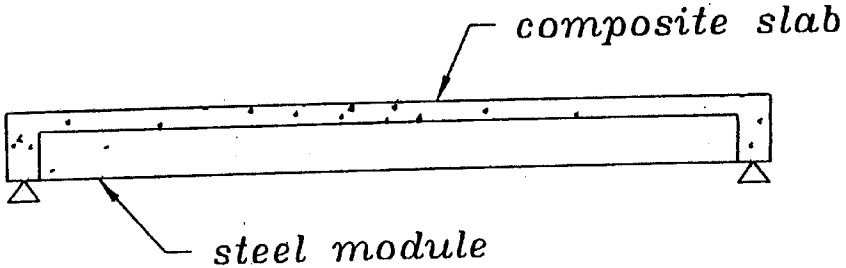
FIG. 65B is an elevational view of a composite slab over the top and ends of a steel module.

FIGS. 63–65 illustrate shear studs 330 connected on the surfaces of a multi-cell module 332. The studs 330 are typically nail-like members made of metal and are typically intermeshed with reinforcing steel (not shown) over which concrete is poured. The studs 330 may be welded onto the structure, and provide shear strength to reinforce the concrete by bonding to the concrete. As shown in FIGS. 63 and 64, the shear studs 330 are provided on the upper surface of the module 332. As best seen in FIGS. 63 and 65, the shear studs 330 are provided on the diaphragm plates 82 near the ends of the sections 336. The shear studs 330 are also formed along the side interior surfaces of the sections 336 adjacent and exterior to the diaphragm plates 82, which will be filled with concrete. The dimensions shown in FIGS. 63–65 are for illustrative purposes only. To facilitate the pouring of the concrete in those locations, the upper portion at the ends of the sections 336 are notched, as best seen in FIG. 65. FIG. 65A shows the cross-section along A—A of FIG. 63 which illustrates more clearly the locations of the shear studs 330 in the module section 336. In FIG. 65B, a composite slab is shown overlaying the steel module 332, including the ends. The composite slab strengthens the bridge module 332 and further seals and protects the areas internally from any atmospheric corrosion.

Dimpled Structure

Figures 66, 66A, 67:
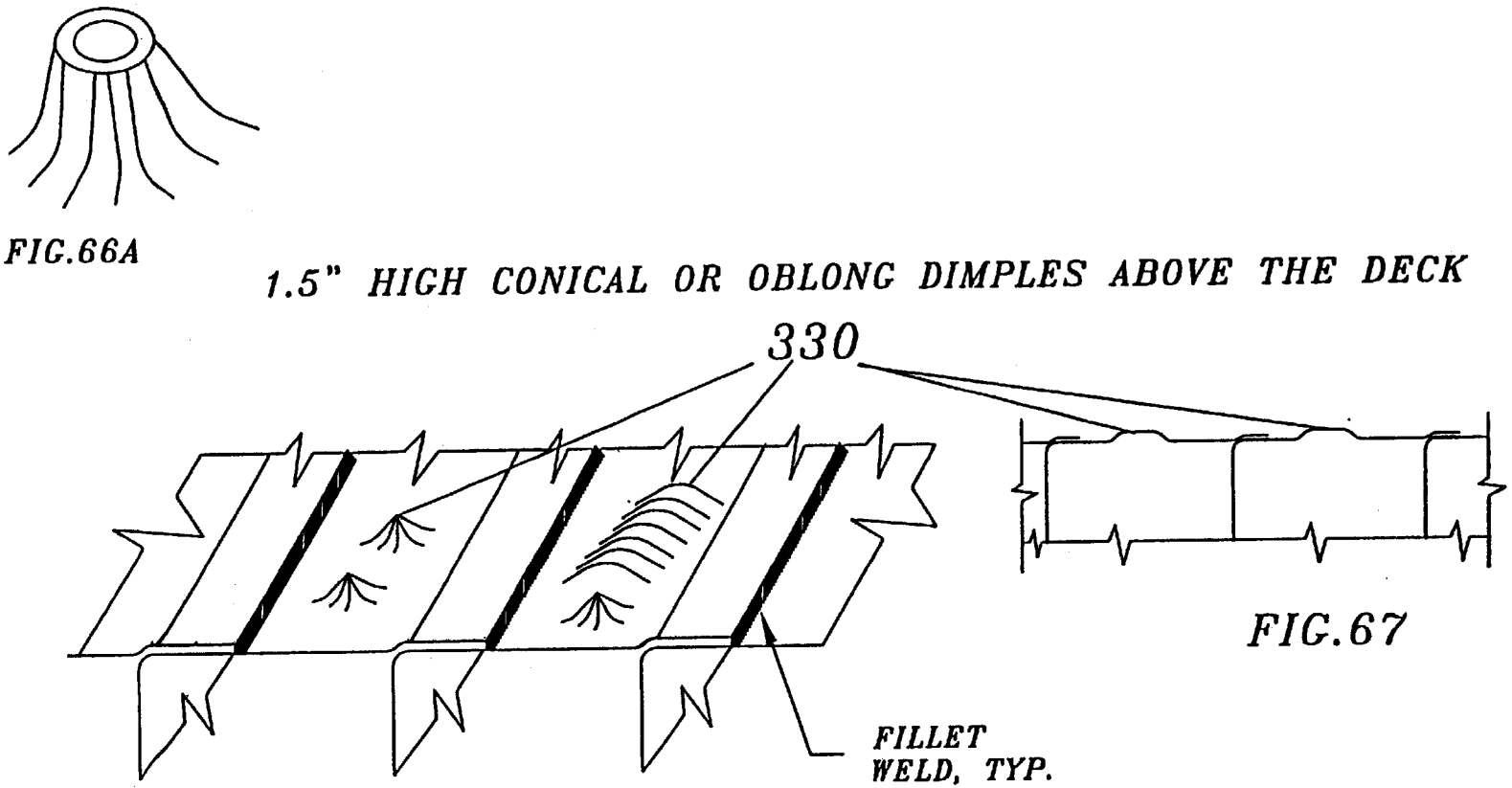
FIG. 66 is a perspective view schematically illustrating dimples on the top surface of a multi-cell bridge module.
FIG. 67 is an elevational view of the module of FIG. 66 with the dimples.

FIGS. 66 and 67 illustrate a dimpled structure having dimples 340 that may be conical or oblong over the upper surfaces of the bridge modules. The dimples 340 may typically be about 1.5 inches high, and serve the function of the shear studs 330 of FIGS. 63–65. The dimples 340 also serve as stiffeners for the sheet-like structural members for the bridge modules similar to the corrugations described above. The dimples 340 may be formed in various ways, such as by stamping. A punch and die (not shown) may be designed to form the dimples 340. The stamping of the dimples 340 is faster than welding shear studs 330, making it more desirable in terms of speed, and eliminating the cost and inventory of the shear studs 330.

Arrangement of Wood Roadway Surface

Figure 68:
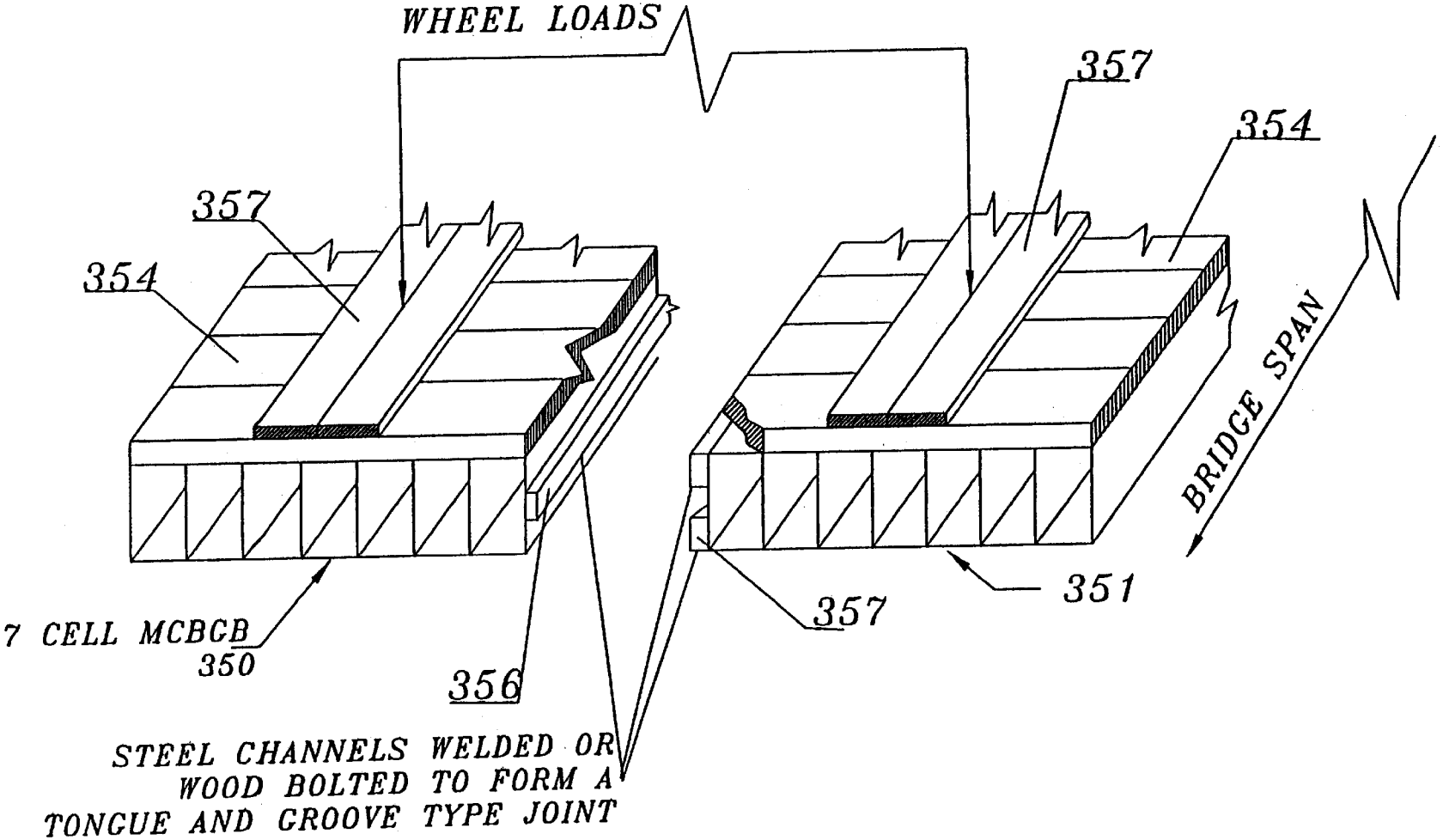
FIG. 68 is a perspective view schematically illustrating the connecting mechanism for a pair of multi-cell modules and the arrangement of wood pieces to form a timber deck over the modules.
Figure 69:
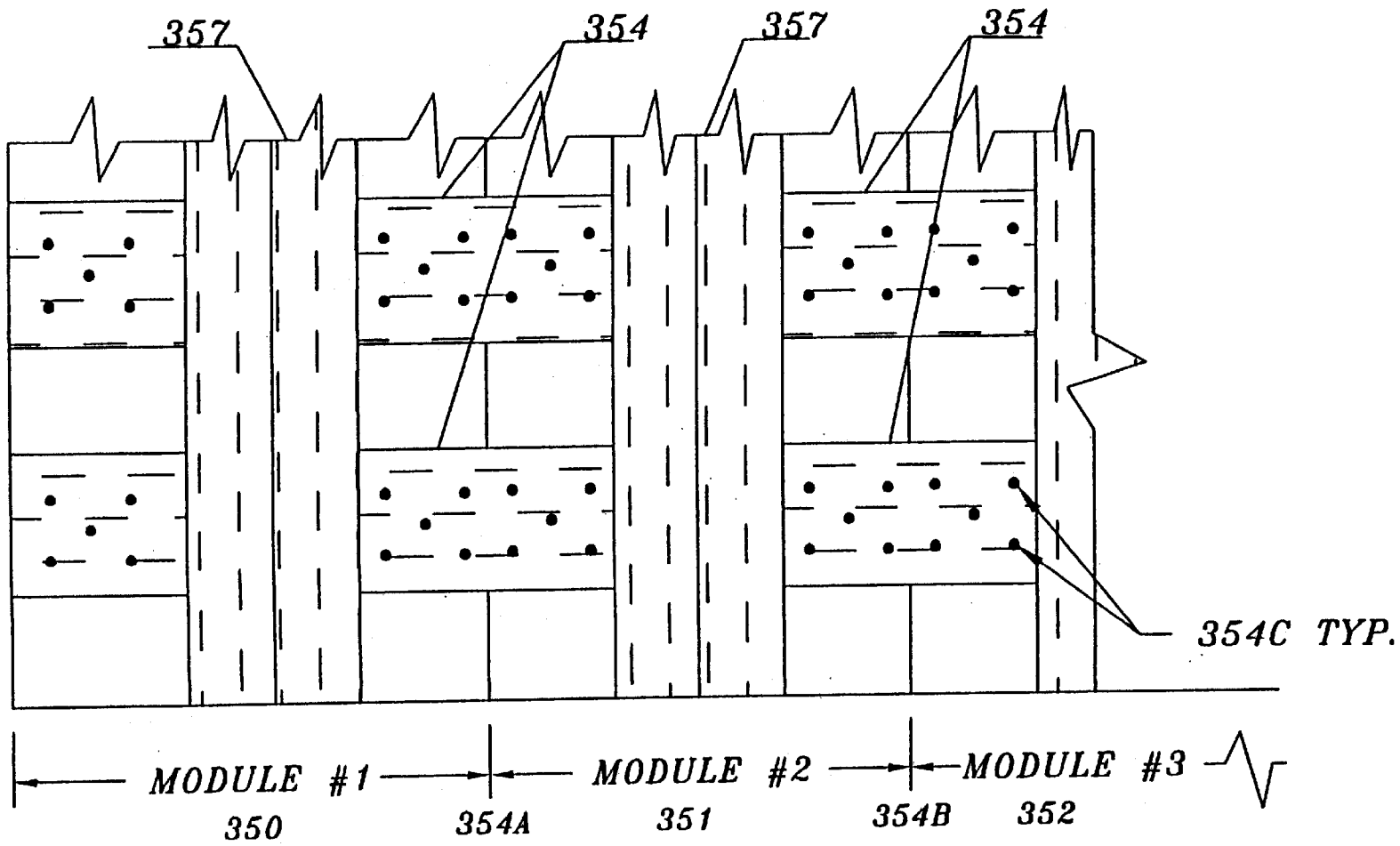
FIG. 69 is a partial top plan view schematically illustrating the timber deck of FIG. 68 formed over three connected multi-cell modules.

Referring to FIGS. 68 and 69, a first module 350, second module 351, and third module 352 combine to form a bridge structure or form. A layer of wood 354 is bolted and oriented transverse to the longitudinal direction of the cells of the three modules 350, 351, 352. The third module 352 is similar in structure to the first and second modules, and is partially shown in FIG. 69. The layer of wood 354 over the three modules forms a timber deck. The orientation of the wood 354 relative to the orientation of the cells of the modules advantageously distributes the loading over the cells 352 rather than concentrating the loading on one cell 352. Such an orientation also distributes the loading over the three modules 350, 351, 352 to maintain the connection of the modules. FIG. 69 shows only some of the wood beams of the layer 354 to reveal more clearly the structure. FIG. 69 also more clearly shows the joint 354A where the modules 350, 351 join and, similarly, the joint 354B joins modules 351, 352 together. Further, it is more desirable that the deck timbers 354 are each unitary pieces and are continuous over the respective joints 354A, 354B in order to help transfer the wheel loads from one module such as 350 to the adjacent module 351. Fasteners 354C shown are typically used for fastening the wood timbers to the modules steel deck. The connection of the modules 350, 351 is illustrated in FIG. 68, and employs a joint having a tongue 356 on one module 350 and a groove 357 on the other module 351. A similar joint (not shown) may be used between the second and third modules 351, 352.

Lying on top of the layer of wood 350 are two sets of pairs of wood beams 357 disposed transverse to the beams of the underlying layers of wood 354. The wood beams 357 are used for supporting wheel loads of vehicles traveling over the bridge. The transverse orientation takes advantage of the stress distribution over the layer of wood 354 for improved strength of the overall structure.

Guardrail Post Connections

FIGS. 70–75 show various methods of connecting guardrail posts to the sides of bridges. Although the bridges shown are MCBGB systems, the illustrated connections may be applied to any type of bridge with modifications.

Referring to FIGS. 70–72, a pair of guardrail posts 360 are connected to the ends of an MCBGB bridge 362 each by two pair of bolts 364, 365. The posts 360 are hollow box-like or rectangular tubing posts as seen in FIG. 72. Each pair of lower bolts 364 extend from the inner surface of the edge of the bridge 362 across the width of the post 360 to the exterior surface 366 of the post 360. Each pair of upper bolts 365 extend from an anchor 367 welded on the upper steel deck surface 367A of the bridge 362 to the exterior surface 366 of the post 360. The upper bolts 365 are much longer and greater in diameter than the lower bolts 364, and provide a stronger connection for the upper surface of the bridge 362 where the loading is highest. The anchor 367 is best seen in FIG. 72, and comprises three longitudinal plates 368 aligned with the direction of the upper bolts 365 welded to a transverse plate 369 through which the upper bolts 365 extend and against which the upper bolts 365 are anchored. Two stiffeners plates 369A are shown welded internally in the post 360 respectively above and below the bolt 365 to give the post 360 additional strength. Other methods of anchoring the bolts 365 may be used. The dimensions shown in FIGS. 70–72 are merely illustrative.

Figure 73:
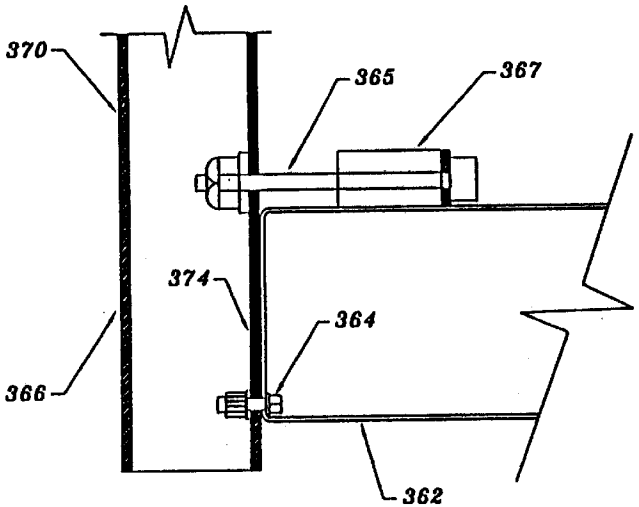
FIG. 73 is a partial elevational view schematically illustrating another embodiment of a connection between a guardrail post and the end of a bridge.
Figure 74:
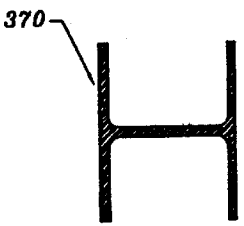
FIG. 74 is a cross-sectional view schematically illustrating the wideflange post of FIG. 73.

Instead of the box-like guardrail post 360 of FIGS. 70–72, standard wideflange posts 370 as shown in FIGS. 73 and 74 may be used. The wideflange post 370 is H-shaped and has three plate-like components that are approximately equal in width. In this embodiment, the upper bolts 365 and lower bolts 364 do not extend through the width of the wideflange post 370, but are connected to a flange 374 adjacent the edge of the bridge 362. This connection is not as strong as the connection of FIGS. 70–72. It is particularly desirable for the upper bolt 365 to extend through the width of the post 370 and to have reinforcing plates welded in above and below the bolts on each side internally (not shown) in the post 370, similar to the stiffener plates 369A shown in FIG. 71, for withstanding the loading on the bridge 362.

Figure 75:
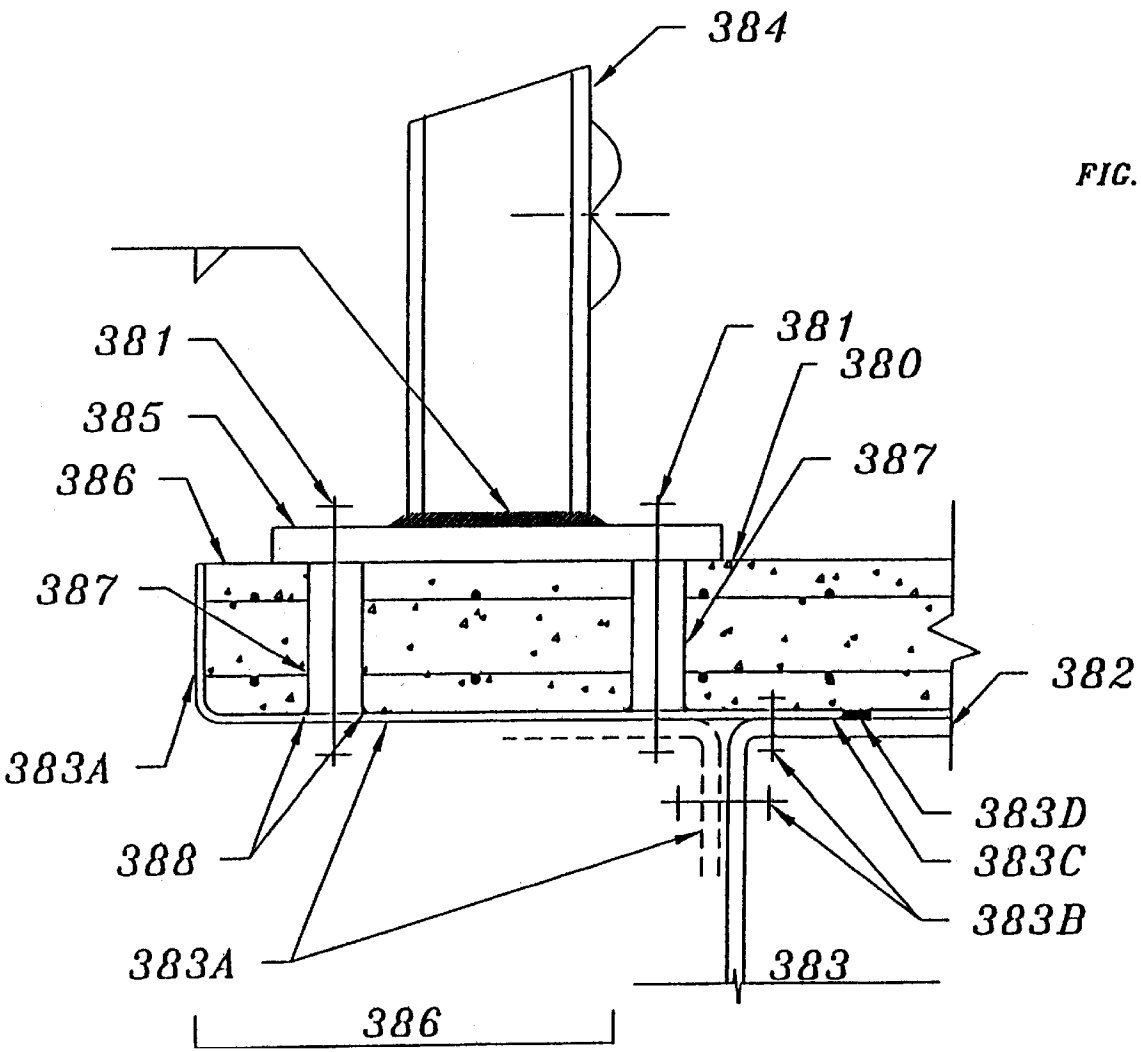
FIG. 75 is a partial elevational view schematically illustrating the connection of a guardrail post and a side of an overhanging bridge deck.

Referring to FIG. 75, an overhanging bridge deck 380 extends beyond the edge 382 of the bridge structure or form 383 to support a guardrail post 384. The overhanging portion 386 of the deck 380 desirably has four embedded tubes 387 welded 388 to the form 383A facing upwardly to receives mounting bolts 381 that are used to mount the base 385 of the post 384 to the overhanging deck 386. An S-shaped metal form 383A or "L" shaped form 383C can be shipped out to the jobsite with the bridge module and installed in the field, e.g., by bolting 383B or by welding 383D, after the modules are installed, and would save forming costs in the field. Bridge modules widths and weights could thereby be reduced for shipping. This configuration facilitates easier and quicker replacement and repair of the guardrail post 384.

Modular Sections

FIG. 76 shows a generally U-shaped or C-shaped section 390 having a base 392 and slightly diverging arms 394. The degree of divergence may range from very small to under 90°, and is desirably below about 30°, and more desirably about 3°.

FIG. 77 illustrates a bridge module 396 comprising a series of the divergent C-shaped sections 390 cooperating with each other with the diverging arms 394 of each section overlapping with portions of the arms 394 of the adjacent section 390. An end section or cap 398 cooperates with the seventh (last) section 390 to form a last closed cell. The overlapped region may be welded or bolted similar to those shown in FIGS. 3 and 4A. Advantageously, the divergent C-shaped sections 390 are easy and quick to assemble, and does not require expensive tooling necessary for assembly of other sections such as those with offsets.

Referring to FIG. 78, a shallow U-shaped section 400 has a base 402 and two relative short arms 404 extending generally parallel to one another and perpendicular to the base 402. These shallow U-shaped sections 400 are disposed in an upright U-shaped manner opposite from those disposed in an inverted U-shaped manner in the bridge module 408 illustrated in FIG. 79. Each pair of upright and inverted U-shaped sections 400 are spaced from each other horizontally, and connected at the top and bottom by a pair of connecting plates 410 that overlap portions of the generally horizontal bases 402 of the sections 400. Each pair of upright and inverted U-shaped sections are connected together by welds 414 or other suitable methods to form a box beam 419. The connecting plates 410 are connected to the bases 402 of the sections 400 by welds 418 or bolts or other methods to form closed cells. This bridge system could be assembled without the bottom plates. In addition, "X" bracing (not shown) between the box beams 419 may also be shop or field installed depending on the size of the members and requirements of the job.

Figure 80:
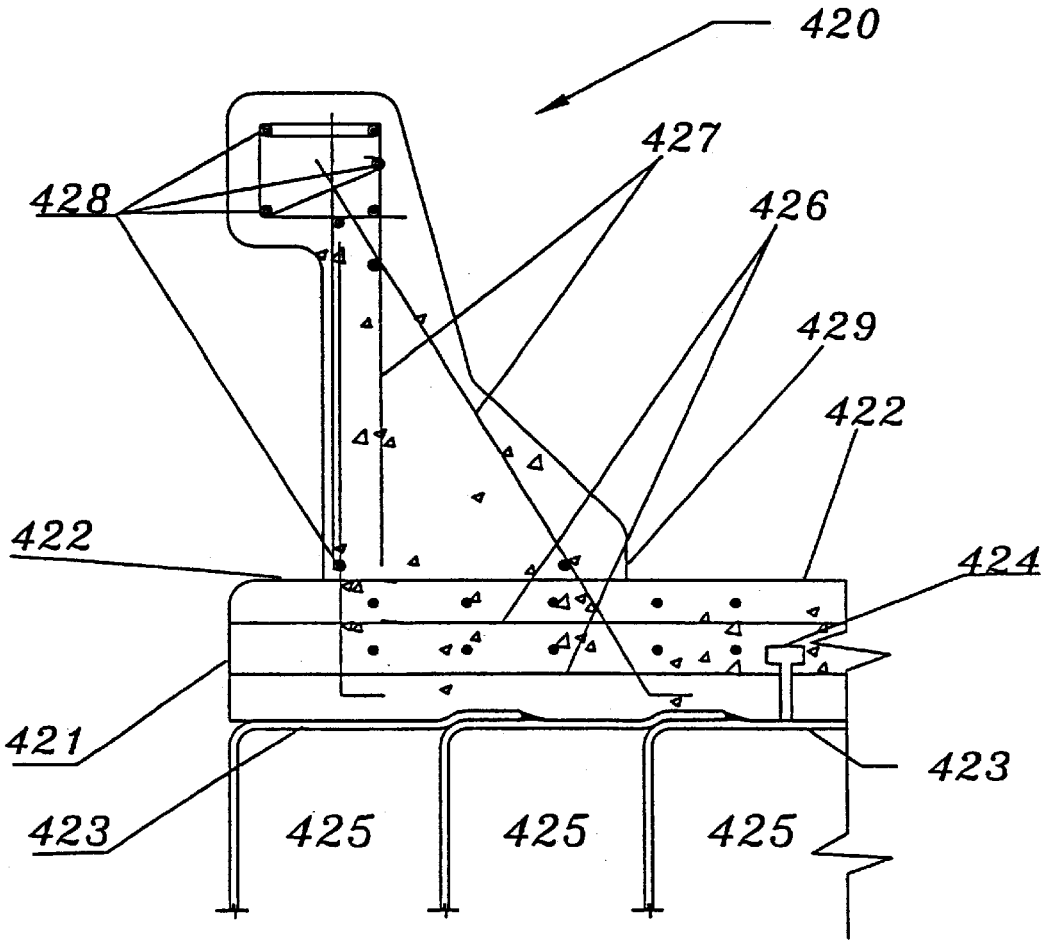
FIG. 80 is an end elevational view of a concrete barrier rail on the edge of an multi-cell box-girder bridge deck.

FIG. 80 shows an end elevational view of a concrete barrier rail 420 on the left side 421 of an MCBG bridge deck 422. The concrete bridge deck 422 is connected to the bridge's steel deck 423, typically with metal shear studs 424. Only one shear stud 424 is shown for clarity. Normally there would be multiple rows of shear studs on top of each cell of the MCBGB modules 425, such as illustrated in FIGS. 63 and 65A. Reinforcing steel 426 is shown in the composite slab. Additional reinforcing steel bars 427 are added in the bridge deck 422 and protrude above the bridge deck and become part of the concrete barrier rail 420 as shown. After the composite bridge deck 422 is poured in the field, the barrier rail 420 typically has additional reinforcing steel 428 added thereto. Concrete is then poured to complete the barrier rail. A construction joint 429 results from the pour. This concrete barrier rail 420 may be a Caltrans standard design widely used in bridges in California and is commonly referred to as a "CONCRETE BARRIER TYPE 25." This type of concrete barrier rail 420 is used in the current MCBGB system. Two CONCRETE BARRIER TYPE 25 will normally be used in this MCBGB system—one on the right and one on the left side of the bridge running parallel to the length of the bridge span. There may also be situations where a similar concrete barrier will be installed in the center of the bridge parallel to the span of the bridge to separate two opposite traveled lanes.

All dimensions in the figures are for illustrative purposes only and are not meant to limit the scope of the present invention. The above-described arrangements of apparatus and methods are merely illustrative of applications of the principles of this invention and many other embodiments and modifications may be made without departing from the spirit and scope of the invention as defined in the claims.

What is claimed is:

1. A bridge for carrying traffic between spaced-apart supports for the bridge, having a first module that comprises:

a plurality of longitudinal sections each having generally horizontal upper and lower members overlapping respectively portions of the generally horizontal upper and lower members of a neighboring section, and each having at least one generally vertical member extending between the upper and lower horizontal members and spaced from a generally vertical member of a neighboring section to define one of a plurality of closed cells, the generally horizontal upper members of the plurality of longitudinal sections including upper surfaces which are substantially aligned with each other, the generally horizontal upper and lower members of each longitudinal section comprising a pair of offset lips at free ends of the upper and lower members, the offset lip at a free end of the upper horizontal member being generally vertically offset from the substantially aligned upper surfaces of the longitudinal sections to form an upper offset protruding generally vertically from the upper surfaces of the longitudinal sections;

a pair of diaphragm plates connected to inner surfaces within each closed cell adjacent longitudinal ends of the closed cell to form an air-tight closed cell; and a plurality of shear studs connected to the outer surfaces of the diaphragm plates.

2. The bridge of claim 1, wherein the plurality of longitudinal sections comprise a plurality of C-shaped sections oriented in a first direction and connected to each other in series to form a plurality of the closed cells and one open cell at an end with the upper and lower horizontal members pointing in the first direction.

3. The bridge of claim 2, wherein the plurality of longitudinal sections further comprise a shallow C-shaped end section oriented in a second direction opposite from the first direction, the upper and lower horizontal members of the shallow C-shaped end section coupling with the upper and lower horizontal members of the C-shaped section of the open cell to change the one open cell to a closed cell.

4. The bridge of claim 2, wherein the pair of offset lips at free ends of the generally horizontal upper and lower members of each C-shaped longitudinal section are offset by about the thickness of the generally horizontal members of the adjacent C-shaped section at overlapped regions, the offset lips overlapping the adjacent C-shaped section at the overlapped regions.

5. The bridge of claim 2, wherein each pair of generally horizontal members of each C-shaped longitudinal section are slightly divergent to form an open end that is slightly larger than the generally vertical member of the adjacent section, portions of the divergent members adjacent the open end overlapping a portion of the divergent member of the adjacent section to form overlapped regions.

6. The bridge of claim 1, wherein the offset lips are offset from the generally horizontal upper and lower members by about the thickness of the generally horizontal members of the adjacent longitudinal section at overlapped regions.

7. The bridge of claim 1, further comprising a bridge flooring having a generally flat top and a notched bottom disposed over the longitudinal sections, the notched bottom including notches cooperating with the upper offsets of the longitudinal sections.

8. A bridge for carrying traffic between spaced-apart supports for the bridge, having a first module that comprises a plurality of longitudinal sections each having generally horizontal upper and lower members overlapping respectively portions of the generally horizontal upper and lower members of a neighboring section, and each having at least one generally vertical member extending between the upper and lower horizontal members and spaced from a generally vertical member of a neighboring section to define one of a plurality of closed cells; a pair of diaphragm plates connected to inner surfaces within each closed cell adjacent longitudinal ends of the closed cell to form an air-tight closed cell; and a plurality of shear studs connected to outer surfaces of the diaphragm plates.

9. The bridge of claim 1, wherein the plurality of longitudinal sections comprise a plurality of Z-shaped sections oriented in a first direction and connected to each other in series to form a plurality of the closed cells and two open cells at two ends, the two open cells including a first open cell having a lower horizontal member extending in a first direction and a second open cell having an upper horizontal member extending in a second direction opposite from the first direction.

10. The bridge of claim 9, wherein the plurality of longitudinal sections further comprise an L-shaped end section and a J-shaped end section, the L-shaped end section having a long upper horizontal member overlapping a portion of the upper horizontal member and a short lower horizontal member overlapping a portion of the lower horizontal member of the Z-shaped section at the first open cell, the J-shaped section having a short upper horizontal member overlapping a portion of the upper horizontal member and a long lower horizontal member overlapping a portion of the lower horizontal member of the Z-shaped section at the second open cell.

11. The bridge of claim 8, wherein the generally horizontal members of the longitudinal sections form tight fit with the adjacent section at overlapped regions.

12. The bridge of claim 8, wherein the longitudinal sections are connected together by welding about overlapped regions.

13. The bridge of claim 12, wherein the longitudinal sections are connected together by fillet welds about the overlapped regions.

14. The bridge of claim 8, wherein the longitudinal sections are connected together by bolting at overlapped regions.

15. The bridge of claim 8, wherein the longitudinal sections are shop-fabricated.

16. The bridge of claim 8, further comprising at least one additional diaphragm plate connected to inner surfaces within each closed cell between the pair of diaphragm plates that are disposed adjacent the longitudinal ends of the closed cell.

17. The bridge of claim 8, wherein the longitudinal sections are roll-formed from metal plates.

18. The bridge of claim 8, further comprising a second module having a plurality of longitudinal sections connected adjacent to each other, the number of longitudinal sections in the second module being different from the number of longitudinal sections in the first module.

19. The bridge of claim 8, wherein the longitudinal sections are connected in a skewed manner relative to each other.

20. The bridge of claim 19, wherein the plurality of longitudinal sections comprise a plurality of C-shaped sections oriented in a first direction and connected to each other in series to form a plurality of the closed cells and one open cell at an end with the upper and lower horizontal members pointing in the first direction.

21. The bridge of claim 20, wherein the generally horizontal upper and lower members of each C-shaped longitudinal section comprise a pair of offset lips at free ends of the horizontal members, the offset lips being offset by about the thickness of the generally horizontal members of the adjacent C-shaped section at overlapped regions, the offset lips overlapping the adjacent C-shaped section at the overlapped regions.

22. The bridge of claim 20, wherein the generally horizontal upper and lower members of each C-shaped longitudinal section are slightly divergent to form an open end that is slightly larger than the generally vertical member of the adjacent section, portions of the divergent members adjacent the open end overlapping a portion of the divergent member of the adjacent section to form overlapped regions.

23. The bridge of claim 19, wherein the plurality of longitudinal sections comprise a plurality of Z-shaped sections oriented in a first direction and connected to each other in series to form a plurality of the closed cells and two open cells at two ends, the two open cells including a first open cell having a lower horizontal member extending in a first direction and a second open cell having an upper horizontal member extending in a second direction opposite from the first direction.

24. The bridge of claim 23, wherein the plurality of longitudinal sections further comprise an L-shaped end section and a J-shaped end section, the L-shaped end section having a long upper horizontal member overlapping a portion of the upper horizontal member and a short lower horizontal member overlapping a portion of the lower horizontal member of the Z-shaped section at the first open cell, the J-shaped section having a short upper horizontal member overlapping a portion of the upper horizontal member and a long lower horizontal member overlapping a portion of the lower horizontal member of the Z-shaped section at the second open cell.

25. The bridge of claim 19, wherein the generally horizontal upper and lower members of each longitudinal section comprise a pair of offset lips at free ends of the horizontal members.

26. The bridge of claim 25, wherein the offset lips are offset from the generally horizontal upper and lower members by about the thickness of the generally horizontal members of the adjacent longitudinal section at overlapped regions.

27. The bridge of claim 19, wherein the generally horizontal members of the longitudinal sections form a tight fit with the adjacent section at overlapped regions.

28. The bridge of claim 19, wherein the generally horizontal upper and lower members of each longitudinal section comprise a pair of offsets adjacent the generally vertical member offset by about the thickness of the generally horizontal members of the adjacent longitudinal section at overlapped regions.

29. The bridge of claim 19, wherein the longitudinal sections are connected together by welding about overlapped regions.

30. The bridge of claim 29, wherein the longitudinal sections are connected together by fillet welds about the overlapped regions.

31. The bridge of claim 19, wherein the longitudinal sections are connected together by bolting at overlapped regions.

32. The bridge of claim 19, further comprising at least one additional diaphragm plate connected to inner surfaces within each closed cell between the pair of diaphragm plates that are disposed adjacent the longitudinal ends of the closed cell.

33. The bridge of claim 19, wherein the longitudinal sections are longitudinally offset progressively by a constant distance.

34. The bridge of claim 8, further comprising a second module having a plurality of the longitudinal sections connected adjacent to each other, the second module disposed adjacent the first module.

35. The bridge of claim 34, wherein the second module is spaced from the first module, and wherein the first and second modules are joined together by a slab.

36. The bridge of claim 8, wherein the generally vertical members comprise a corrugation.

37. The bridge of claim 36, wherein the corrugation is provided in a center region of each of the generally vertical members.

38. The bridge of claim 8, wherein the upper horizontal member includes a corrugation.

39. The bridge of claim 38 wherein the corrugation is perpendicular to a longitudinal axis of the longitudinal section.

40. The bridge of claim 38, wherein the corrugation comprises a portion having a thickness larger than the remaining portion of the horizontal member.

41. The bridge of claim 38, wherein the corrugation comprises a large trapezoidal portion.

42. The bridge of claim 41, wherein the lower horizontal member has a corrugation comprising a large trapezoidal portion.

43. The bridge of claim 41, wherein the corrugation extends longitudinally along the upper horizontal member of the longitudinal section.

44. The bridge of claim 8, further comprising a generally flat bridge flooring disposed above the longitudinal sections.

45. The bridge of claim 8, further comprising a plurality of support plates connected above the longitudinal sections, the support plates extending beyond the longitudinal sections for attachment to abutments.

46. The bridge of claim 8, further comprising a plurality of shear studs connected to the inner surfaces of each closed cell between the longitudinal ends and the diaphragm plates.

47. The bridge of claim 8, wherein the upper horizontal members comprise a plurality of dimples.

48. The bridge of claim 47, wherein the dimples are conical or oblong.

49. The bridge of claim 8, further comprising a deck disposed over the longitudinal sections, the deck overhanging the edge of an end longitudinal section for supporting a guardrail post.

50. The bridge of claim 8, further comprising a second module having a plurality of the series of longitudinal sections connected adjacent to each other substantially the same as the first module, and a third module having a plurality of the series of longitudinal sections connected adjacent to each other substantially the same as the first module, the first module having a longitudinal lip along a longitudinal side, the second module have a longitudinal groove along a longitudinal side for cooperating with the longitudinal lip of the first module to connect with the first module, the second module have a longitudinal lip along another longitudinal side opposite from the longitudinal groove, and the third module have a longitudinal groove along a longitudinal side for cooperating with the longitudinal lip of the second module to connect with the second module.

51. The bridge of claim 50 further comprising a bridge tower and a plurality of cables connected between the bridge tower and the modules.

52. The bridge of claim 50 further comprising a supporting arch and a plurality of vertical columns connected between the supporting arch and the modules.

53. The bridge of claim 8, further comprising a guardrail post connected to an end surface of the generally vertical member of an end longitudinal section.

54. The bridge of claim 53, wherein the guardrail post is welded to the end surface of the generally vertical member.

55. The bridge of claim 53, wherein the guardrail post is bolted to the end surface of the generally vertical member.

56. The bridge of claim 55, further comprising a backing plate connected to an interior surface of the generally vertical member for receiving bolts for bolting the guardrail post to the generally vertical member.

57. The bridge of claim 8, further comprising a plurality of shear studs connected to the upper horizontal members.

58. A bridge for carrying traffic between spaced-apart supports for the bridge, having a first module that comprises a plurality of longitudinal sections each having generally horizontal upper and lower members overlapping respectively portions of the generally horizontal upper and lower members of a neighboring section, and each having at least one generally vertical member extending between the upper and lower horizontal members and spaced from a generally vertical member of a neighboring section to define one of a plurality of closed cells, a second module having a plurality of the series of longitudinal sections connected adjacent to each other substantially the same as the first module; a third module having a plurality of the series of longitudinal sections connected adjacent to each other substantially the same as the first module, the first module having a longitudinal lip along a longitudinal side, the second module having a longitudinal groove along a longitudinal side for cooperating with the longitudinal lip of the first module to connect with the first module, the second module having a longitudinal lip along another longitudinal side opposite from the longitudinal groove, and the third module having a longitudinal groove along a longitudinal side for cooperating with the longitudinal lip of the second module to connect with the second module; and a series of parallel wood panels each disposed over and extending across the first, second, and third modules, the wood panels being oriented substantially perpendicular to the longitudinal axes of the first, second, and third modules.

59. The bridge of claim 58, further comprising two sets of wood panels disposed over and extending across the series of parallel wood panels, the two sets of wood panels being spaced from one another and oriented substantially perpendicular to the series of parallel wood panels.

60. A bridge for carrying traffic between spaced-apart supports for the bridge, having a first module that comprises:

a plurality of longitudinal sections each having generally horizontal upper and lower members overlapping respectively portions of the generally horizontal upper and lower members of a neighboring section, and each having at least one generally vertical member extending between the upper and lower horizontal members and spaced from a generally vertical member of a neighboring section to define one of a plurality of closed cells, wherein the longitudinal sections are connected in a skewed manner relative to each other, wherein the plurality of longitudinal sections comprise a plurality of C-shaped sections oriented in a first direction and connected to each other in series to form a plurality of the closed cells and one open cell at an end with the upper and lower horizontal members pointing in the first direction, wherein the plurality of longitudinal sections further comprise a shallow C-shaped end section oriented in a second direction opposite from the first direction, the upper and lower horizontal members of the shallow C-shaped end section coupling with the upper and lower horizontal members of the C-shaped section of the open cell to change the one open cell to a closed cell;

a pair of diaphragm plates connected to inner surfaces within each closed cell adjacent longitudinal ends of the closed cell to form an air-tight closed cell; and a plurality of shear studs connected to the outer surfaces of the diaphragm plates.

61. A bridge for carrying traffic between spaced-apart supports for the bridge, having a first module that comprises a plurality of longitudinal sections each having generally horizontal upper and lower members overlapping respectively portions of the generally horizontal upper and lower members of a neighboring section, and each having at least one generally vertical member extending between the upper and lower horizontal members and spaced from a generally vertical member of a neighboring section to define one of a plurality of closed cells; a guardrail post; at least one bolt connected to the guardrail post; and an anchor connected to at least one upper horizontal member for anchoring the at least one bolt connected to the guardrail post.

62. The bridge of claim 61, wherein the at least one bolt extends from the anchor through the width of the guardrail post and is connected therethrough.

* * * * *